US007144669B2

(12) United States Patent
Suzuki et al.

(10) Patent No.: US 7,144,669 B2
(45) Date of Patent: Dec. 5, 2006

(54) CARRIER AND DEVELOPER FOR LATENT ELECTROSTATIC IMAGE DEVELOPMENT, CONTAINER HOUSING DEVELOPER, IMAGE FORMING PROCESS, IMAGE FORMING APPARATUS, AND PROCESS CARTRIDGE

(75) Inventors: Kousuke Suzuki, Shizuoka (JP); Tomio Kondou, Shizuoka (JP); Masahide Yamashita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 129 days.

(21) Appl. No.: 10/798,871

(22) Filed: Mar. 12, 2004

(65) Prior Publication Data

US 2004/0234876 A1 Nov. 25, 2004

(30) Foreign Application Priority Data

| | | |
|---|---|---|
| Mar. 13, 2003 | (JP) | 2003-068789 |
| Sep. 25, 2003 | (JP) | 2003-333794 |
| Nov. 27, 2003 | (JP) | 2003-397997 |
| Dec. 26, 2003 | (JP) | 2003-434900 |

(51) Int. Cl.
*G03G 9/00* (2006.01)

(52) U.S. Cl. ..... 430/111.1; 430/111.31; 430/111.32; 430/111.33

(58) Field of Classification Search ..... 430/111.1, 430/111.31, 111.32, 111.33; 399/252
See application file for complete search history.

(56) References Cited

U.S. PATENT DOCUMENTS 5,576,133 A * 11/1996 Baba et al. ..... 430/111.31
6,363,229 B1 3/2002 Shiraishi et al.
6,403,275 B1 6/2002 Kuramoto et al.
6,406,826 B1 6/2002 Suzuki et al.
6,500,595 B1 12/2002 Mochizuki et al.
6,503,676 B1 1/2003 Yamashita et al.
6,566,026 B1 5/2003 Watanabe et al.
6,630,276 B1 10/2003 Sugiura et al.
6,653,037 B1 11/2003 Sawada et al.
6,716,561 B1 4/2004 Shiraishi et al.
6,743,558 B1 6/2004 Yamaguchi et al.
2003/0036010 A1 2/2003 Suzuki et al.
2003/0165765 A1 9/2003 Yamashita et al.
2004/0185366 A1* 9/2004 Shinmura et al. ..... 430/111.33

OTHER PUBLICATIONS

U.S. Appl. No. 11/270,731, filed Nov. 10, 2005, Suzuki et al.
U.S. Appl. No. 11/378,424, filed Mar. 20, 2006, Suzuki et al.

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A carrier for electrostatic development contains a core particle and a coating layer covering the core particle, and the core particle is a ferrite particle containing at least one of Zr in an amount of 0.005% by mass to 5% by mass and Bi in an amount of 0.001% by mass to 1% by mass. The carrier shows a sufficient resistance, is stably charged over a long period of time, can avoid roughness and irregular density in halftone images, prevents deposition of the carrier particles on a photoconductor, can satisfactorily reproduce character images and can produce high-quality images over a long period of time. The carrier is usable for constituting a developer, a container housing the developer, an image forming apparatus and process, and process cartridge using the developer.

13 Claims, 7 Drawing Sheets

CARRIER AND DEVELOPER FOR LATENT ELECTROSTATIC IMAGE DEVELOPMENT, CONTAINER HOUSING DEVELOPER, IMAGE FORMING PROCESS, IMAGE FORMING APPARATUS, AND PROCESS CARTRIDGE

BACKGROUND OF THE INVENTION

1. Field of the Invention

The present invention relates to a carrier which is used for developing a latent electrostatic image formed on a photoconductor to form a visible image; a developer containing the carrier and a toner; a container housing the developer; and an image forming process, an image forming apparatus, and process cartridge using the developer.

2. Description of the Related Art

In the prior art, in electrophotography apparatuses and electrostatic recording apparatuses, an electrical or magnetic latent image is rendered visible by a toner. For example, in the electrophotography process, an electrostatically charged image (latent image) is formed on a photoconductor, and this latent image is then developed using a toner to form a toner image. This toner image is usually transferred to a transfer material such as paper, and subsequently fixed by a process such as heating.

In general, the toner used for the electrostatically charged image development comprises coloring particles containing a colorant, charge control agent and other additives in a binder resin, and may be manufactured, broadly speaking, by a pulverization process or a suspension polymerization process.

In the pulverization process, toner is manufactured by melt-mixing the colorant, charge control agent and offset inhibitor, uniformly dispersing them in a thermoplastic resin, and then pulverizing and classifying the composition obtained. By the pulverization process, a toner having excellent characteristics can be manufactured, but selection of toner materials is limited.

For example, the composition obtained by melt mixing must be a material which can be pulverized and classified by an economically viable apparatus. Due to this requirement, the composition which is melt-mixed must be sufficiently brittle to be pulverized and classified.

Thus, when the composition is actually pulverized to particles, a particle size distribution with a wide range is easily formed, and if it is attempted to obtain a copy image with good resolution and gradation, fines with a particle size of for example 5 μm or less and coarse powder of 20 μm or more must be removed, so the yield becomes very low. Additives such as a coloring agent and charge control agent cannot be uniformly dispersed in a thermoplastic resin according to the pulverization process. Uneven dispersion of the components has an adverse effect on toner fluidity, development and durability, and image quality.

Recently, to overcome the problem in these pulverization processes, it was proposed to manufacture the toner by a polymerization process such as suspension polymerization process, and this process is now being used. Such toner particles for electrostatic development are prepared, for example, by suspension polymerization. However, the toner particles obtained by the suspension polymerization process are spherical, and they are not easy to clean off. In development and transfer of an image with a low image occupancy, the amount of a residual toner after transfer is small and the cleaning failure does not become a problem. However, in development and transfer of an image with a high image occupancy or in the case that a toner constituting an image is not transferred due to paper feed failure and remains on the photoconductor, the cleaning failure leads to toner deposition on the background of images. In addition, such a residual toner may be deposited on a charger roller for contact-charging the photoconductor and other members, thus reducing the inherent charging ability of them.

To solve these problems, Japanese Patent No. 2537503 discloses a process of preparing fine resin particles by emulsion polymerization and associating the fine resin particles with one another to thereby yield toner particles having irregular shapes.

However, even if the toner particles obtained by emulsion-polymerization are subjected to a water rinsing process, as surfactant remains not only on the surface but also in the interior of the particles, the environmental stability of the toner charge is adversely impacted, the charge distribution is broadened, and the obtained image is soiled. Moreover, the remaining surfactant also contaminates the photoconductor, charge roller and developing roller, so that they are not able to manifest their original charging capability.

Toner particles for use in an image-fixing process, in which an image is fixed by contact heating using a heating member such as heating roller, must have satisfactory releasing properties with respect to the heating member (hereinafter may be referred to as "anti-offset performance"). The anti-offset performance can be improved by arranging a releasing agent on the surface of toner particles. Japanese Patent Application Laid-Open (JP-A) No. 2000-292973 and No. 2000-292978 each propose a process for imparting the anti-offset performance to toner particles by arranging fine resin particles mainly in a surface layer of toner particles in addition to compounding them within the toner particles. However, these techniques invite an elevated lowest image-fixing temperature, thus deteriorating properties in low-temperature image-fixing systems for energy saving.

The processes, in which toner particles having irregular forms are prepared by associating resin particles prepared by emulsion polymerization, have the following disadvantages. When particles of a release agent are associated to improve the anti-offset performance of the toner, the release agent particles are included inside the toner particles, and thereby the anti-offset performance of the toner cannot be improved satisfactorily. In addition, since resin particles, release agent particles and coloring agent particles are randomly mixed and fused to form toner particles, the composition of the toner particles varies (i.e., contents of the toner constituents in the toner particles vary) and in addition the molecular weight of the binder resin in the toner particles varies. As a result, the individual toner particles have different surface properties, and therefore the toner cannot stably produce good images over a long period of time. In an image forming system which requires the toner to have a low temperature fixability, the toner prepared by arranging fine resin particles on the surface thereof invites poor image-fixing due to the toner particles having the resin particles unevenly present on their surface, and therefore the toner cannot be used therefor because of having a narrow fixing temperature range.

Developing systems in the electrophotography are roughly divided into one-component developing systems using a toner alone as a main component and two-component developing systems using a mixture of a toner and a carrier such as glass beads and magnetic particles with or without resin coating.

The two-component developing systems use a carrier with a wider contact charging area with respect to the toner, have stable charging properties and are advantageous for yielding high-quality images over a long period of time as compared with the one-component developing systems. They can highly feed the toner to a developing region and are often used in high-speed machines.

The two-component developing systems are also widely employed in digital electrophotographic systems in which a latent electrostatic image is formed on a photoconductor typically using laser beams and is developed to form a visible image.

Such latent images must have smaller minimum unit (one dot) with higher density to produce images with higher resolution and higher highlight reproducibility or to produce color images. A strong demand has therefore been made to provide developing systems that can reproduce these latent images (dots) in exact accordance. To satisfy the demand, various proposals have been made on process conditions and developers (toners and carriers). Relating to the process conditions, a smaller developing gap, a thinner photoconductor, and a smaller diameter of write beams are effective. However, these techniques lead to higher cost and have still insufficient reliability.

Relating to developers, the use of a toner having a small particle diameter significantly improves the reproducibility of dots. However, such a developer containing a toner with a small particle diameter may invite toner deposition on the background of images and insufficient image density. A full-color toner with a small particle diameter uses a resin with low softening point to produce sufficient colors but invites a larger amount of spent toner on the carrier, thus deteriorating the developer and often inviting scattering of toner particles and toner deposition on the background of images.

Various proposals have been made on the use of carriers with a small particle diameter. The carriers with a small particle diameter have the following advantages.

(1) These carriers have a large surface area and can thereby impart sufficient charges to individual toner particles by friction, thus avoiding toner particles with a low charge or with an opposite charge. They can therefore satisfactorily reproduce dots (images) with less toner deposition on the background of images and with less dust and bleeding of the toner around the dots.

(2) These carriers have a large surface area and can prevent toner deposition on the background of images. Therefore, the toner particles can have a decreased average charge to produce sufficient image density. Accordingly, the carriers with a small particle diameter can supplement the disadvantages of and enhance the advantages of the toners with a small particle diameter.

(3) The carriers with a small particle diameter can form fine magnetic brush with good flowability, thus avoiding traces or marks of the magnetic brush on images.

Along with the use of carriers with a small particle diameter having the above advantages, various materials of core particles for carrier particles have been proposed to reduce loads on the environment. More specifically, a Cu—Zn ferrite has been often used for the material for core particles, but it is now less used, due to its constitutional copper and zinc elements. Mn ferrites are now often used instead of the Cu—Zn ferrite. The Mn ferrites often include Mg among various additives to improve their properties. For example, Japanese Patent No. 3243376 discloses a technique of adding Mg and Sr to a Mn ferrite to reduce variation in magnetization among carrier particles. Various improvements thus have been made on the Mn ferrites with an increasing use thereof to thereby improve their quality. However, these Mn ferrites have a low resistance and invite image failure such as irregular image density in a halftone image when their magnetic properties are set within regular usable regions.

Conventional carriers with a small particle diameter often invite deposition or scattering of carrier particles, which causes damage on the photoconductor or image-fixing roller, and are thereby difficult to use in practice.

To solve these problems, Japanese Patent No. 3243376 proposes a specific carrier having a volume-average particle diameter of 25 to 45 μm, containing particles with a particle diameter of 22 μm or less in an amount of 1% or less and having magnetization of 67 to 88 emu/g in a magnetic field of 1 kilooersted, in which scattered particles have a magnetization 10 emu/g lower than that of inherent particles. This technique can reduce deposition of carrier particles but significantly invites "rough image", a spotted image density irregularity in a test on an analogue halftone image using a developing system in which a direct-current voltage is superimposed with an alternating-current voltage as developing bias. The analogue halftone image in a digital machine used in this test is in the similitude of a digital image with high precision of 1200 dpi or more and the test is a forced test for next-generation digital images with higher precision. In contrast, the rough image is trivial in low-precision digital image formation of around 400 dpi.

JP-A No. 2002-296846 proposes a technique for uniformizing a halftone image by reducing the particle diameter of carrier. In this technique, the irregularity in halftone images is considered to be caused by varying particle diameters. In contrast, the concern in the present invention is irregularity in halftone images caused by electrical factors. To verify the difference between them, the present inventors have made a test on a copier CF-70 (available from Konica Minolta Business Technologies, Inc.) used as a test machine in JP-A No. 2002-296846 and have found that the CF-70 is a full-color copier with a resolution of 400 dpi, and the irregularity in halftone image which is a problem to be solved by the present invention is not observed therein.

Generally, digital images can be reproduced in exact accordance with inputted images more satisfactorily with an increasing resolution of images. This is also true in electrophotography, and investigations on images with higher resolution of 1200 dpi or higher have revealed that smooth images can be produced in highlight or halftone densities at such a high resolution.

However, a higher resolution alone is insufficient to yield a higher image quality, and individual dots constituting the image must have high dot uniformity. The term "dot uniformity" used herein means that each dot bears a toner in an amount with less variation from dot to dot. In an image with a higher resolution, each dot bears a decreasing amount of a toner with a decreasing diameter of dot as compared with an image with a lower resolution. Target high-quality images with smooth entire appearance can be obtained by uniformizing the amount of toner in each dot. In contrast, if each dot bears a toner in an amount largely varying from dot to dot, the difference between the amounts of the toner leads to images with uneven densities. In this connection, images with a lower resolution are not so affected by irregular densities caused by decreased dot uniformity, since each dot in these images bears a larger amount of the toner. To produce high-quality images with higher resolution, investigations have been made to improve the dot uniformity of individual dots.

The "roughness (rough image)" as evaluated in the present invention is a phenomenon in which a rough irregularity in density occurs in images of highlight to halftone densities and which is caused by a decreased dot uniformity. The rough image tends to occur in images with high resolution. The analogue halftone image as tested in the present invention corresponds to an output image of the highest resolution. If the roughness can be improved in the analogue halftone image, high-quality images with high resolution can be produced.

The copier CF-70 is a machine for producing images with a resolution of 400 dpi (one dot: about 60 μm) and does not invite the rough image. More specifically, the irregularity in halftone images observed in JP-A No. 2002-296846 is caused by the difference in particle diameters, and the copier used in this technique cannot detect the rough image, i.e., the irregularity in halftone images caused by electrical factors. Accordingly, the technique is not a solution to the problems in the present invention.

Ferrite carriers such as Ni—Zn ferrite, Mn—Zn ferrite or Cu—Zn ferrite have a dielectric breakdown voltage of 1000 V or more, can avoid leakage of the potential of latent electrostatic image on a photoconductor to the carrier during development, and do not invite brush strokes. However, these ferrite carriers have an excessively high density. To avoid this disadvantage, JP-A No. 07-225497 discloses the use of a Li—Fe ferrite containing 17.0 to 29.0% by mole of lithium oxide to $Fe_2O_3$ and describes that such a Li ferrite has a saturation magnetization of about 43 to 70 emu/g ($Am^2/kg$). In the examples and comparative examples in the publication, the maximum saturation magnetization is 62 $Am^2/kg$ under the application of a magnetic field of 3000 oersteds. It is highly possible that the ferrite disclosed in JP-A No. 07-225497 will have a saturated magnetization of less than 70 $Am^2/kg$ when determined at 1000 oersteds. Accordingly, this ferrite is a low-magnetized ferrite and is distinguished from a high-magnetized ferrite used in the present invention.

JP-A No. 11-202559 described that a Li—Fe ferrite often shows varying properties, since the Li component is susceptible to humidity and temperature, and discloses a ferrite containing 5 to 35% by mole of MoO, 10 to 45% by mole of MgO and 45 to 55% by mole of $Fe_2O_3$ to avoid this problem. However, this ferrite is a low magnetization ferrite and is distinguished from the ferrite used in the present invention.

JP-A No. 06-35230 and No. 06-51563 disclose carriers mainly comprising a ferrite and having specific average particle diameter, bulk density and intensity of magnetization. However, these carriers are mainly intended to prevent adhesion or deposition of carrier particles to a latent electrostatic image bearing member such as photoconductor and do not still have a sufficient resistance.

OBJECTS AND ADVANTAGES

Accordingly, an object of the present invention is to provide a carrier and developer for electrostatic development, which produce a sufficient resistance and can avoid images with irregular densities (roughness) in halftone regions due to low resistance, even when their magnetic properties are set within regular usable regions.

Another object of the present invention is to provide a carrier and developer for electrostatic development, which prevent adhesion or deposition of the carrier particles, produce halftone images without roughness, can satisfactorily reproduce character images and can stably maintain their charges over a long period of time without deteriorating advantages of carriers with a small particle diameter.

Still another object of the present invention is to provide a container housing the developer, an image forming process and image forming apparatus using the developer, and a process cartridge housing the developer.

SUMMARY OF THE INVENTION

After intensive investigations to achieve the above objects and to solve the problems of the conventional technologies, the present inventors have found that the objects can be satisfactorily achieved by the present inventors as mentioned below. Specifically, the present invention provides a carrier containing a core particle and a coating layer covering the core particle, in which the core particle is a ferrite particle containing at least one of Zr in an amount of 0.01% by mass to 5% by mass and Bi in an amount of 0.005% by mass to 1% by mass. The resistance of the carrier can be increased without decreasing its magnetic moment by compounding at least one of Zr and Bi.

In the carrier, the ferrite particle as the core particle preferably comprises Fe, Mn and Mg in amounts of 15% by mass to 45% by mass, 1% by mass to 25% by mass, and 0.1% by mass to 1.0% by mass, respectively.

The present invention also provides a carrier containing a core particle and a coating layer covering the core particle, in which the core particle is a ferrite particle containing at least one of Zr in an amount of 0.005% by mass to 4% by mass and Bi in an amount of 0.001% by mass to 0.9% by mass.

In this carrier, the ferrite particle as the core particle preferably comprises Fe, Mn and Mg in amounts of 10% by mass to 40% by mass, 1% by mass to 25% by mass, and 0.1% by mass to 1.0% by mass, respectively.

The carrier preferably has a magnetic moment of 65 to 90 $Am^2/kg$ at 1 kilooersted and shows a dielectric breakdown voltage of 1000 V or more as determined by applying a direct-current voltage to the carrier using a measuring instrument having a rotary sleeve housing a fixed magnet at a predetermined position and electrodes being arranged at a distance of 1 mm from the sleeve.

The carrier preferably has a magnetic moment of 65 to 90 $Am^2/kg$ at 1 kilooersted and shows a dielectric breakdown voltage of 500 V or more as determined using a bridge measuring instrument by applying a direct-current voltage to the particles in a chain form at a distance between electrodes of 2 mm±0.3 mm (1.7–2.3 mm) in a magnetic field of 1500 gauss.

The present invention also provides a developer containing a toner in the form of particles including at least a binder resin and a coloring agent; and the aforementioned carrier.

The present invention further provides a container housing the developer.

The present invention also provides an image forming apparatus at least including a latent electrostatic image bearing member for bearing a latent electrostatic image; a device for forming a latent electrostatic image on the latent electrostatic image bearing member; a device for developing the latent electrostatic image using a developer to form a visible image; a device for transferring the visible image to a recording medium; and a device for fixing the transferred image on the recording medium, in which the developer is the aforementioned developer.

In addition, the present invention provides an image forming process including processes of forming a latent electrostatic image on a latent electrostatic image bearing member; developing the latent electrostatic image using a developer to form a visible image; transferring the visible image to a recording medium; and fixing the transferred image on the recording medium, in which the developer is the aforementioned developer.

Advantageously, the present invention provides a process cartridge being attachable to and detachable from a main body of image forming apparatus and integrally containing a image-developer for developing a latent electrostatic image bearing member using a developer to form a visible image; and at least one selected from the group consisting of a latent electrostatic image bearing member for bearing a latent electrostatic image; a device for forming a latent electrostatic image on the latent electrostatic image bearing member and a cleaner, in which the developer is the aforementioned developer of the present invention.

Further objects, features and advantages of the present invention will become apparent from the following description of the preferred embodiments with reference to the attached drawings.

DESCRIPTION OF THE PREFERRED EMBODIMENTS

Carrier for Electrostatic Development

Figure 1:
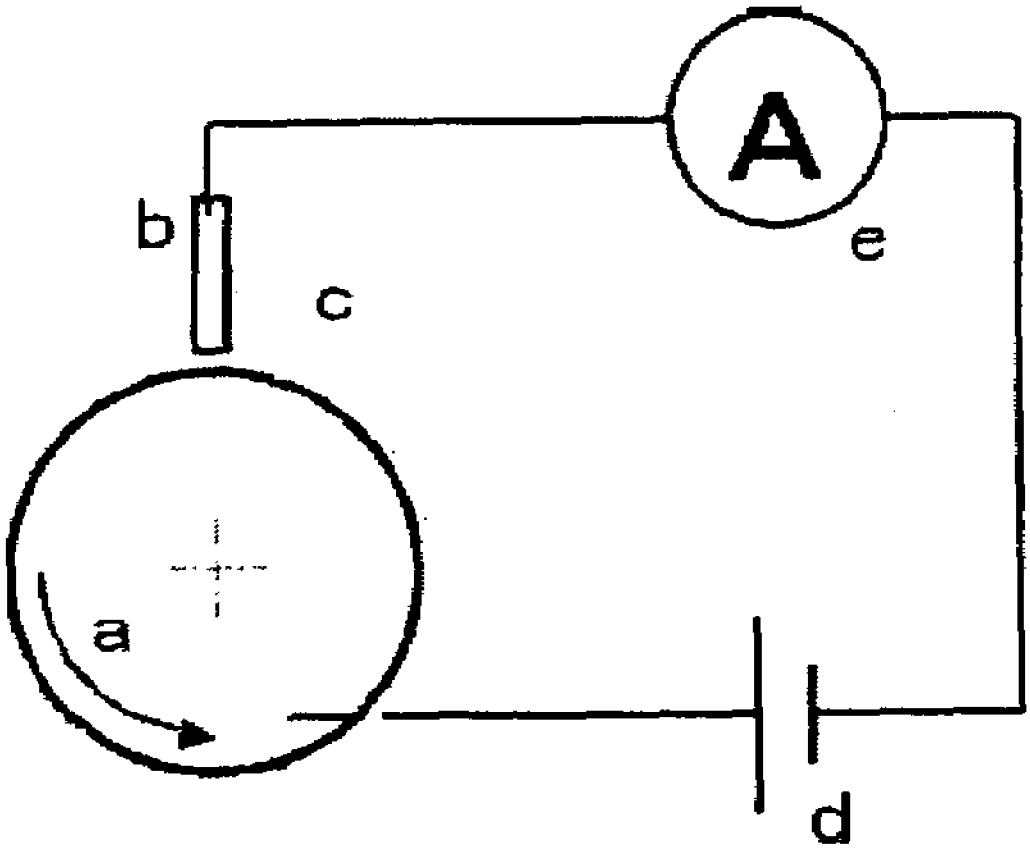
FIG. 1 is a schematic diagram of a measuring instrument for dielectric breakdown voltage of carrier.

The carrier for electrostatic development of the present invention comprises carrier particles, each carrier particle comprising a core particle and a coating layer covering the core particle, wherein the core particle is a ferrite particle comprising at least one of Zr in an amount of 0.01% by mass to 5% by mass and Bi in an amount of 0.005% by mass to 1% by mass.

If the content of Zr is less than 0.01% by mass, the Zr component does not sufficiently exhibits its advantages. In contrast, if it exceeds 5% by mass, the carrier comprises an excessively large amount of Zr, thus leading to decreased magnetic moment.

In addition to the actions of Zr, Bi has a low melting point and can thereby serve to smooth and uniformize the shape and surface conditions of the carrier particles. These advantages of Bi can be exhibited even in a small amount as specified above. If the content of Bi is less than 0.005% by mass, the Bi component does not sufficiently exhibit its advantages. If it exceeds 1% by mass, the carrier contains an excessively large amount of Bi, thus leasing to decreased magnetic moment, and the carrier particles may become excessively soft to thereby fail to satisfactorily control the shape and surface conditions of the particles.

The combination use of Zr and Bi is typically preferred for exhibiting the advantages of the two components synergistically and for yielding carrier particles with good shape and surface conditions and with satisfactory magnetic moment and resistance at high levels.

In the carrier, the ferrite particle as the core particle preferably comprises Fe, Mn and Mg in amounts of 15% by mass to 45% by mass, 1% by mass to 25% by mass, and 0.1% by mass to 1.0% by mass, respectively.

By containing Fe, Mn and Mg in the above-specified amounts, the ferrite core particle may have well-balanced magnetic moment, resistance and other properties. If the contents are out of the above-specified ranges, the ferrite core particle may not have such well-balanced properties.

In another aspect, the carrier for electrostatic development of the present invention comprises carrier particles, each carrier particle comprising a core particle and a coating layer covering the core particle, wherein the core particle is a ferrite particle comprising at least one of Zr in an amount of 0.005% by mass to 4% by mass and Bi in an amount of 0.001% by mass to 0.9% by mass.

If the content of Zr is less than 0.005% by mass, the Zr component does not sufficiently exhibits its advantages. In contrast, if it exceeds 4% by mass, the carrier comprises an excessively large amount of Zr, thus leading to decreased magnetic moment.

In addition to the actions of Zr, Bi has a low melting point and can thereby serve to smooth and uniformize the shape and surface conditions of the carrier particles. These advantages of Bi can be exhibited even in a small amount as specified above. If the content of Bi is less than 0.001% by mass, the Bi component does not sufficiently exhibit its advantages. If it exceeds 0.9% by mass, the carrier contains an excessively large amount of Bi, thus leasing to decreased magnetic moment, and the carrier particles may become excessively soft to thereby fail to satisfactorily control the shape and surface conditions of the particles.

The combination use of Zr and Bi is typically preferred for exhibiting the advantages of the two components synergistically and for yielding carrier particles with good shape and surface conditions and with satisfactory magnetic moment and resistance at high levels.

In this carrier, the ferrite particle as the core particle preferably comprises Fe, Mn and Mg in amounts of 10% by mass to 40% by mass, 1% by mass to 25% by mass, and 0.1% by mass to 1.0% by mass, respectively.

By containing Fe, Mn and Mg in the above-specified amounts, the ferrite core particle may have well-balanced magnetic moment, resistance and other properties. If the contents are out of the above-specified ranges, the ferrite core particle may not have such well-balanced properties.

Further preferably, the carrier particles have a weight-average particle diameter Dw of 20 to 65 μm, in which the content of carrier particles having a particle diameter of 9 μm or less is 3.0% by weight or less. The carrier more preferably has a magnetic moment of 40 to 90 $Am^2/kg$ at 1 kilooersted.

Carrier particles having a weight-average particle diameter Dw less than 20 μm may have deteriorated uniformity, thus leading to adhesion or deposition of the carrier particles. Carrier particles having a weight-average particle diameter Dw exceeding 65 μm may not reproduce details of images satisfactorily and may not produce fine images. Carrier particles containing particles having a particle diameter of 9 μm or less in an amount exceeding 3.0% by weight may have deteriorated uniformity, thus leading to carrier adhesion or deposition, as in the carrier particles having a weight-average particle diameter Dw less than 20 μm.

When the magnetic moment is within the above-specified range, the carrier particles may have appropriate holding power therebetween, and the toner component can be rapidly and satisfactorily dispersed into the carrier or developer. If the magnetic moment is less than 40 $Am^2/kg$ at 1 kilooersted, the carrier particles may be adhered or deposited due to their insufficient magnetic moment.

In contrast, if it exceeds 90 $Am^2/kg$ at 1 kilooersted, the brush of the developer formed during development may become excessively hard, thus the developer may not satisfactorily reproduce details of images and may fail to produce fine and precise images.

In a preferred embodiment (1), the carrier comprises a core particle and a coating layer covering the core particle, wherein the core particle is a ferrite particle comprising at least one of Zr in an amount of 0.005% by mass to 4% by mass and Bi in an amount of 0.001% by mass to 0.9% by mass, and the carrier has a magnetic moment of 65 to 90 $Am^2/kg$ at 1 kilooersted and shows a dielectric breakdown voltage of 1000 V or more as determined by applying a direct-current voltage to the carrier using a measuring instrument having a rotary sleeve housing a fixed magnet at a predetermined position and electrodes being arranged at a distance of 1 mm from the sleeve.

In another preferred embodiment (2), the carrier comprises a core particle and a coating layer covering the core particle, wherein the core particle is a ferrite particle comprising at least one of Zr in an amount of 0.005% by mass to 4% by mass and Bi in an amount of 0.001% by mass to 0.9% by mass, and the carrier has a magnetic moment of 65 to 90 $Am^2/kg$ at 1 kilooersted and shows a dielectric breakdown voltage of 500 V or more as determined using a bridge measuring instrument by applying a direct-current voltage to the particles in a chain form at a distance between electrodes of 2 mm±0.3 mm (1.7–2.3 mm) in a magnetic field of 1500 gauss.

By compounding Zr and/or Bi to the carrier, the carrier can have an increased dielectric breakdown voltage without decreasing its magnetic moment. If the content of Zr is less than 0.005% by mass, the Zr component may not sufficiently exhibit its advantages. In contrast, if it exceeds 4% by mass, the carrier may comprise an excessively large amount of Zr, thus leading to decreased magnetic moment.

In addition to the actions of Zr, Bi has a low melting point and can thereby serve to smooth and uniformize the shape and surface conditions of the carrier particles. These advantages of Bi can be exhibited even in a small amount as specified above. If the content of Bi is less than 0.001% by mass, the Bi component does not sufficiently exhibit its advantages. If it exceeds 0.9% by mass, the carrier may contain an excessively large amount of Bi, thus leasing to decreased magnetic moment, and the carrier particles may become excessively soft to thereby fail to satisfactorily control the shape and surface conditions of the particles.

The Zr and Bi components are contained preferably in the form of elementary substances or compounds and more preferably contained in the form of compounds. As the compounds, oxides and carbides are preferred.

When the magnetic moment is within the above-specified range, the carrier particles may have appropriate holding power therebetween, and the toner component can be rapidly and satisfactorily dispersed into the carrier or developer. If the magnetic moment is less than 65 $Am^2/kg$ at 1 kilooersted, the carrier particles may be adhered or deposited due to their insufficient magnetic moment. In contrast, if it exceeds 90 $Am^2/kg$ at 1 kilooersted, the brush of the developer formed during development may become excessively hard, thus the developer may not satisfactorily reproduce details of images and may fail to produce fine and precise images.

The dielectric breakdown voltage as determined in the preferred embodiment (1), the present inventors have found that the formation of rough image is correlated with the dielectric breakdown voltage as determined by applying a direct-current voltage to the carrier using a measuring instrument having a rotary sleeve housing a fixed magnet at a predetermined position and electrodes being arranged at a distance of 1 mm from the sleeve. A carrier having a dielectric breakdown voltage as determined by the above process of 1000 V or more can produce images with less roughness. This is probably because a carrier having a lower dielectric breakdown voltage may invite a larger leakage in development to thereby produce latent electrostatic images with deteriorated properties. The carrier having a dielectric breakdown voltage as determined by the above process of 1000 V or more also exhibits a higher allowance with respect to deposition of carrier particles. This is because a carrier having a lower dielectric breakdown voltage may often induce charges to its core particle and thereby invite deposition of carrier particles. The deposition of carrier particles increases with an increasing linear velocity of the photoconductor and an increasing linear velocity of the development sleeve.

The dielectric breakdown voltage as used herein refers to a voltage at the time when the resistance rapidly drops, namely at the time when an excess current rapidly flows, and refers to a voltage at which the current begins to flow. At a voltage lower than the dielectric breakdown voltage, the current is prevented from flowing by action of the carrier.

The present inventors have also found that the formation of rough image is correlated with the dielectric breakdown voltage as determined by applying a direct-current voltage to the particles in a chain form at a distance between electrodes of 2 mm±0.3 mm in a magnetic field of 1500 gauss. Specifically, when the carrier has a dielectric breakdown voltage of 500 V or more as determined under the aforementioned conditions using a bridge measuring instrument, the roughness in images can be improved. This is probably because a carrier having a lower dielectric breakdown voltage may invite a larger leakage in development to thereby produce latent electrostatic images with deteriorated properties. The carrier having a dielectric breakdown voltage of 500 V or more as determined under the aforementioned conditions also exhibits a higher allowance with respect to deposition of carrier particles. This is because a carrier having a lower dielectric breakdown voltage may often induce charges to its core particle and thereby invite deposition of carrier particles. The deposition of carrier particles increases with an increasing linear velocity of the photoconductor and an increasing linear velocity of the development sleeve. The dielectric breakdown voltage as used herein refers to a voltage at the time when the resistance rapidly drops, i.e., an excess current rapidly flows. The resistance herein should be determined with a bridge measuring instrument such as a resistance measuring instrument as described in JP-A No. 07-225497 and must essentially be determined at a distance between electrode of 2 mm±0.3 mm. If a dielectric breakdown voltage is determined with the measuring instrument as described in JP-A No. 07-225497 but at a distance between electrodes of 6.5 mm as in the publication, the measured dielectric breakdown voltage is not correlated with the rough image. This is probably because, at a decreasing distance between electrodes, a current more easily flows thus the dielectric breakdown voltage can be determined with an increasing sensitivity.

In the preferred embodiments (1) and (2), Zr and Bi are preferably used in combination, for exhibiting the advantages of the two components synergistically and for yielding carrier particles with good shape and surface conditions and with satisfactory magnetic moment and resistance at high levels.

In the preferred embodiments (1) and (2), the core particle of the carrier preferably comprises Fe, Mn and Mg in amounts of 10% by mass to 40% by mass, 1% by mass to 25% by mass, and 0.1% by mass to 1.0% by mass, respectively. By comprising Fe, Mn and Mg in the above-specified amounts, the ferrite core particle may have well-balanced magnetic moment, resistance and other properties. If the contents are out of the above-specified ranges, the ferrite core particle may not have such well-balanced properties.

In the preferred embodiments (1) and (2), it is preferred that the carrier particles have a weight-average particle diameter Dw of 20 to 65 μm, and the content of carrier particles having a particle diameter of 9 μm or less is 3.0% by weight or less.

Carrier particles having a weight-average particle diameter Dw less than 20 μm may have decreased uniformity. In addition the magnetization of each particle may be decreased with a decreased average particle diameter, and the number of particles with low magnetization may increase, thus leading to adhesion or deposition of the carrier particles. Carrier particles having a weight-average particle diameter Dw exceeding 65 μm may not reproduce details of images satisfactorily and may not produce fine images. Carrier particles containing particles having a particle diameter of 9 μm or less in an amount exceeding 3.0% by weight may become heterogeneous or non-uniform and have a larger number of lowly magnetized particles, thus leading to carrier adhesion or deposition, as in the carrier particles having a weight-average particle diameter Dw less than 20 μm.

The term "% by mass" used herein means percentages determined based on the atomic weight of the element, is generally used in elementary analysis and is substantially equivalent to "% by weight".

Preparation Process of Core Particle

The core particle used in the carrier can be prepared, for example, by the following process. Suitable amounts of raw materials constituting the ferrite are mixed with a suitable amount of water and are dispersed in a disperser such as a ball mill or vibrating mill to yield a slurry. The slurry is then dried, pulverized and prebaked at 500° C. to 1500° C. The prebaked article is further pulverized in a ball mill to a suitable particle diameter for the target particle diameter of the core particle. The pulverized article is mixed with water, a binder resin, and other additives according to necessity and is granulated by spray drying. The granules are fired at 800° C. to 1600° C., pulverized and classified to a target particle diameter distribution. Where necessary, the surface of particles may be reoxidized. However, the preparation process is not limited to the above process.

The coating layer in the carrier preferably comprises at least one of a silicone resin and an acrylic resin.

The silicone resin has a low surface energy and exhibits high spent resistance. The silicone resin used herein means and includes all silicone resins generally known. Such silicone resins include, but are not limited to, straight silicone resins comprising organosiloxane bonds alone, and modified silicone resins. The modified silicone resins may be, for example, alkyd-modified silicone, polyester-modified silicone, acrylic-modified silicone or urethane-modified silicone.

The straight silicone resins are commercially available under the trade names of KR271, KR255 and KR152 from Shin-Etsu Chemical Co., Ltd.; and SR2400, SR2406 and SR2410 from Dow Corning Toray Silicone Co., Ltd. The straight silicone resin can be used alone or in combination with other components that undergo crosslinking and/or charge control components. The modified silicone resins are commercially available under the trade names of KR206 (alkyd-modified), KR5208 (acrylic-modified), ES1001N (epoxy-modified) and KR305 (urethane-modified) from Shin-Etsu Chemical Co., Ltd.; and SR2115 (epoxy-modified) and SR2110 (alkyd-modified) from Dow Corning Toray Silicone Co., Ltd.

The acrylic resin has high adhesion and elasticity and can form a film with good retention. The acrylic resin used herein means and includes all resins having an acrylic component and is not specifically limited. The acrylic resin can be used alone or in combination with one or more other components that undergo crosslinking. The other components that undergo crosslinking include, but are not limited to, amino resins and acidic catalysts. The amino resins include,-but are not limited to, guanamine and melamine resins. The acidic catalysts for use herein include all acidic catalysts having catalytic activity and include, but are not limited to, acidic catalysts having a reactive group such as fully alkylated group, methylol group, imino group or methylol/imino group.

The silicone resin and the acrylic resin serve to maintain the coating layer stably over a long period of time and to keep satisfactory charges and resistance.

More preferably, the coating layer in the carrier comprises at least a silicone resin and an acrylic resin, in which the weight ratio of the acrylic resin to the silicone resin is from 10% by weight to 90% by weight. The silicone resin and the acrylic resin within this weight ratio can exhibit their advantages in good balance. If the weight ratio of the acrylic resin is less than 10% by weight, sufficient advantages of the acrylic resin may not be obtained. If it exceeds 90% by weight, the proportion of the silicone resin may be too low to exhibit its advantages.

When the coating layer comprises at least a silicone resin and an acrylic resin, the coating layer more preferably comprises at least a layer of the silicone resin and another layer of the acrylic resin.

This configuration is effective to obtain the high spent resistance due to a low surface energy of the silicone resin and the high adhesion and elasticity of the acrylic resin separately. The configuration includes, but is not limited to, a carrier comprising a core particle, a lower coating layer of the acrylic resin adjacent to the core particle and an upper coating layer of the silicone resin adjacent to the lower coating layer. In this case, the carrier particle can have a surface with good properties due to low surface energy of the silicone resin, and the flake off of the coating layer caused by the fragileness of such a silicone resin layer can be compensated by action of the acrylic resin.

Where necessary, the coating layer may further comprise carbon black. The carbon black significantly effectively works as a control agent for reducing the resistance of the coating layer when the layer comprises the coating resin alone or in combination with particles and has a high resistance. When a developer comprises a carrier with high resistance, a copied image with a large image occupancy generally becomes a sharp image with "edge effect" in which the image density at a center part is very low and that in the periphery is very high. By action of the edge effect, a character or thin-line image becomes sharp. However, a halftone image is not reproduced satisfactorily. Accordingly, an appropriate amount of carbon black can produce satisfactory images.

A coating layer containing carbon black can be used in a carrier for color developer by using in combination with an acrylic resin. If a film of a regular carrier for color developer containing carbon black and thus having a dense color flakes off and migrates into an image, the flaking-off film is outstanding in the image to deteriorate the image quality. However, when the coating layer comprises an acrylic resin, the acrylic resin has high adhesion and is resistant to flaking off and can firmly hold the carbon black in the coating layer. In addition, the acrylic resin itself is resistant to flaking off and can prevent flaking-off of the carbon black from the coating layer. These advantages can more satisfactorily be obtained by dispersing the carbon black into the acrylic resin. The carbon black for use herein includes, but is not specifically limited to, all of carbon black generally used in carriers and toners.

The content of an element in the carrier can be determined with a fluorescent X-ray analyzer ZSX 100e (trade name, available from Rigaku Corporation) using EZ scan, element scanning software of the analyzer, in the following manner. A sample core material or carrier is uniformly placed to a seal comprising a polyester film and an adhesive applied on the film to yield a test sample. The test sample is set on a stage, and the content is determined while selecting the conditions [e.g., measurement range: B-U, measurement diameter: 30 mm, sample form: metal, measurement time: long, atmosphere: vacuum].

The magnetic moment can be determined, for example, in the following manner. A total of 1.0 g of a sample core particle of carrier is charged into a cylindrical cell. The cylindrical cell is mounted into B-H Tracer type BHU-60 (trade name, available from Riken Denshi Co., Ltd.) and the sample is exposed to a varying magnetic field. The magnetic field is gradually increased to 3000 oersteds, is then gradually decreased to zero (initial stage). Thereafter, a magnetic field in an opposite direction is applied, is gradually increased to −3000 oersteds and is then gradually decreased to zero (second stage). Subsequently, a magnetic field is gradually increased to 3000 oersteds in the same direction as in the initial stage (third stage). A B-H curve is prepared through the first to third stages. The magnetic moment at an applied magnetic field of 1000 oersteds in the third stage is determined from the B-H curve.

The dielectric breakdown voltage in the preferred embodiment (1) can be determined in the following manner. With reference to FIG. 1, a sleeve "a" is rotated at 250 rpm, 20 g of a sample carrier c is placed on the rotating sleeve, and a voltage E is applied between the sleeve "a" and a doctor electrode b. Two minutes later a current I is read, and a resistance R at the applied voltage E is calculated from E and I according to the following equation: $R=E/I(\Omega)$. The measurement is repeated with an increasing applied voltage to detect the voltage at which a rapid drop of the resistance occurs. The dielectric breakdown voltage is defined as the applied voltage at which the rapid drop of the resistance occurs. The dielectric breakdown voltage as used herein refers to a voltage at the time when the resistance rapidly drops, i.e., an excess current rapidly flows and refers to a voltage at which the current begins to flow. At a voltage lower than the dielectric breakdown voltage, the current is prevented from flowing by action of the carrier.

The dielectric breakdown voltage as determined in the preferred embodiment (2) can be determined in the following manner. A total of 200 mg of a sample carrier is placed between two electrodes in parallel at a distance of 2 mm±0.3 mm, and magnets of 1500 gauss are placed on the outsides of the two electrodes to thereby form a magnetic brush of the carrier. The resistance is determined with an increasing applied voltage, and the dielectric breakdown voltage is defined as the voltage at which a rapid drop of the resistance occurs. The resistance can be measured using a resistance measuring instrument or be determined from a current measured using an ammeter and the applied voltage.

The weight-average particle diameter can be determined by using an SRA family of Microtrac Particle Size Analyzer (trade name, available from NIKKISO Co., Ltd.). The content of particles with a particle diameter of 9 μm or less can be determined by using this instrument in a measurement range of 0.7 to 125 μm.

The developer of the present invention comprises the carrier of the present invention and a toner containing at least a binder resin and a coloring agent. The toner for use in the present invention can be any of general toners such as toners prepared by kneading and pulverization, as well as toners prepared by polymerization.

Toner

Suitable toners for use in the present invention will be described.

The toner preferably has a weight-average particle diameter Dw of 3 to 10 μm for better reproducibility of dots, since the toner particles within this range have a sufficiently small particle diameter with respect to fine latent image dots.

If the weight-average particle diameter Dw is less than 3 μm, the toner may not be efficiently transferred and may not be cleaned satisfactorily. If it exceeds 10 μm, blur or scattering of character images and line images may tend to occur.

The particle size distribution of the toner particles is determined, for example, in the following manner.

The particle size distribution can be determined by means of, for example, a Coulter Counter (trademark) Model TA-II or a Coulter Multisizer II (trademark) (both available from Beckman Coulter, Inc.).

More specifically, the particle size distribution can be determined by the following process.

Initially, a dispersant, i.e., 0.1 ml to 5 ml of surfactant (preferably alkylbenzene sulfonate) is added to 100 ml to 150 ml of electrolytic solution. The electrolytic solution is approximately 1% aqueous solution of NaCl of extra pure sodium chloride, such as ISOTON-II (trade name, available from Beckman Coulter, Inc.). Next, 2 mg to 20 mg of a test sample is added to the electrolytic solution. The electrolytic solution suspending the test sample is dispersed by an ultrasonic disperser for about 1 minute to 3 minutes. Thereafter, toner particles, or volume and number of toner are measured by the above-mentioned apparatus with an aperture of 100 μm, and the volume distribution and number distribution are calculated. The weight-average particle diameter Dw and the number-average particle diameter Dn are then determined from the determined distributions.

As channels, 13 channels of 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm, are used. The object is particles having a diameter range of 2.00 μm to less than 40.30 μm.

Binder resins for use in the toner can be any of known or conventional binder resins and include, but are not limited to, polystyrenes, poly-p-chlorostyrene, polyvinyl toluene, and other homopolymers of styrene and substituted styrenes; styrene-p-chlorostyrene copolymers, styrene-propylene copolymers, styrene-vinyltoluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic ester copolymers, and other styrenic copolymers; poly(methyl methacrylate), poly(butyl methacrylate), poly(vinyl chloride), poly(vinyl acetate), polyethylenes, polyesters, polyurethanes, epoxy resins, poly(vinyl butyral), polyacrylic acid resins, rosin, modified rosin, terpene resins, phenolic resins, aliphatic or aromatic hydrocarbon resins and aromatic petroleum resins. These resins can be used alone or in combination.

Binder resins for use in image-fixing under pressure can be any of known or conventional binder resins and include, but are not limited to, low molecular weight polyethylenes, low molecular weight polypropylenes and other polyolefins; ethylene-acrylic acid copolymers, ethylene-acrylic ester copolymers, ethylene-methacrylic acid copolymers, ethylene-methacrylic ester copolymers, ethylene-vinyl chloride copolymers, ethylene-vinyl acetate copolymers, ionomer resins and other olefinic copolymers; epoxy resins; polyester resins; styrene-butadiene copolymers; polyvinylpyrrolidones; methyl vinyl ether-maleic anhydride copolymers; maleic acid-modified phenolic resins, and phenol-modified terpene resins. Each of these resins can be used alone or in combination.

Any of known or conventional coloring agents and pigments for toners can be used herein. Examples of black coloring agents include, but are not limited to, carbon black, aniline black, furnace black and lamp black.

Examples of cyan coloring agents include, but are not limited to, phthalocyanine blue, methylene blue, Victoria blue, methyl violet, aniline blue and ultramarine blue.

Examples of magenta coloring agents include, but are not limited to, Rhodamine 6G lake, dimethylquinacridone, Watchung Red, rose bengal, Rhodamine 6B and alizarin lake.

Examples of yellow coloring agents include, but are not limited to, chrome yellow, benzidine yellow, Hansa yellow, naphthol yellow, molybdate orange, quinoline yellow and tartrazine.

The toner for use in the present invention may further comprise a charge control agent. Examples of the charge control agent are known or conventional charge control agents for toners and include, but are not limited to, nigrosine dyes, quaternary ammonium salts, amino-containing polymers, metal-containing azo dyes, salicylic acid-metal complex compounds and phenolic compounds.

The toner may further comprise an image-fixing aid, in addition to the binder resin, coloring agent and charge control agent. Thus, the toner can also be used in an oil-less image-fixing system in which an oil for preventing toner adhesion is not applied to image-fixing rollers. The image-fixing aid includes, but is not limited to, conventional image-fixing aids such as polyethylenes, polypropylenes and other polyolefins, fatty acid metal salts, fatty acid esters, paraffin wax, amide waxes, polyhydric alcohol waxes and silicone varnish.

The container of the present invention houses the developer of the present invention.

The image forming process of the present invention uses the developer of the present invention.

Figure 2:
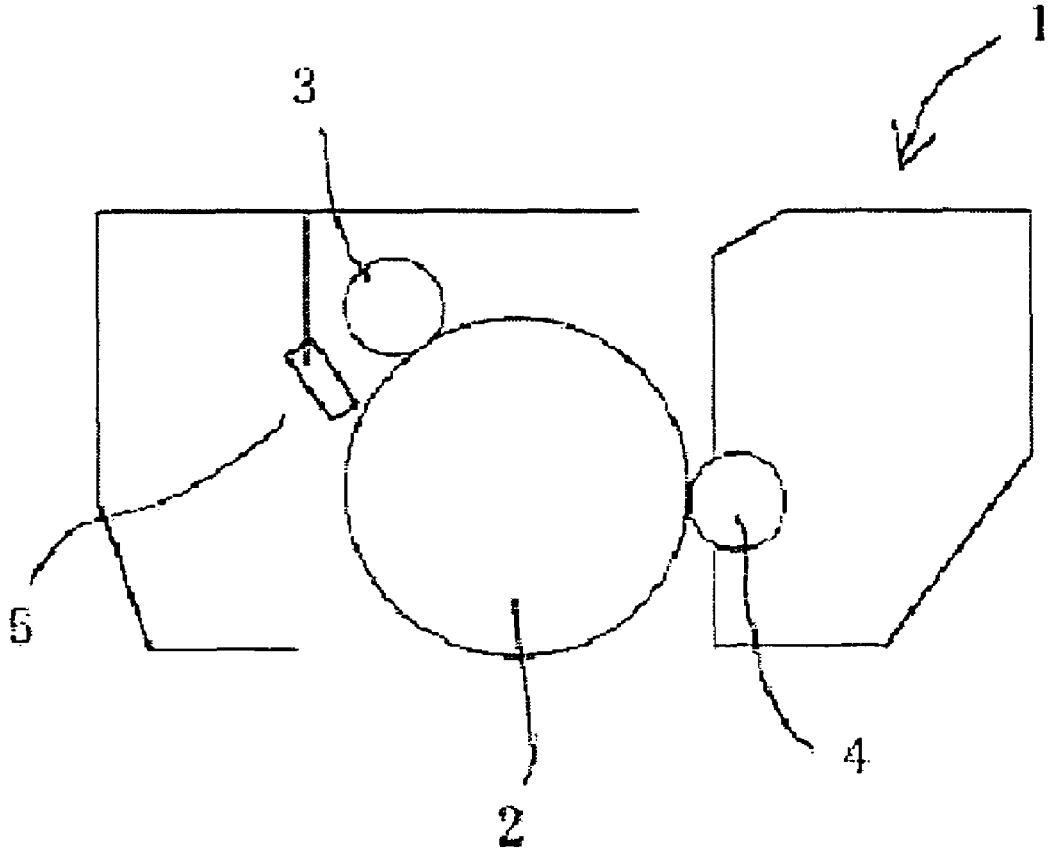
FIG. 2 is a schematic diagram of an example of a process cartridge as an embodiment of the present invention.

FIG. 2 shows a process cartridge housing the developer of the present invention.

FIG. 2 illustrates the process cartridge 1, a photoconductor 2, a charger 3, an image-developer 4 and a cleaner 5.

The process cartridge integrally comprise the image-developer 4 and at least one selected from the photoconductor 2, charger 3 and cleaner 5 and is so configured as being detachable from and attachable to a main body of an image forming apparatus such as a copier or printer.

In the image forming apparatus equipped with the process cartridge housing the developer according to the present invention, the photoconductor is rotated at a predetermined peripheral speed. During the cycle of a rotation of the photoconductor, the charger (charging means) uniformly charges the photoconductor at a predetermined positive or negative potential, thereafter a light irradiator such as of slit exposure or laser beam scanning exposure, applies light imagewise to the charged photoconductor. In this way, latent electrostatic images are sequentially formed on the circumference surface of the photoconductor. The image-developer develops the formed latent electrostatic image with the toner so as to form a toner image, and then the image-transferer sequentially transfers the toner image onto a transfer medium which is fed from a paper feeder to between the photoconductor and the image-transferer at the same timing to the rotation of the photoconductor. The transfer medium bearing the transferred toner image is separated from the photoconductor, and is introduced to the fixer. The fixer fixes the transferred image onto the transfer medium so as to form a reproduction (copy) and then the copy is sent out from the apparatus, i.e., printed out. After transferring the toner image, cleaner removes the remained toner on the surface of the photoconductor so as to clean the surface. Thereafter, the charge of the photoconductor is eliminated for another image formation.

The process cartridge of the present invention houses the developer of the present invention, can thereby improve the problems of conventional technologies and can be easily detached from and attached to an image forming apparatus.

The image forming apparatus of the present invention may comprise a process cartridge which is so configured as being detachable from and attachable to the main body of the apparatus. The process cartridge herein integrally comprises and unites the image-developer and at least one of the photoconductor, cleaner and other components. Alternatively, a process cartridge is so configured as being a single unit detachable from or attachable to the main body of the apparatus by action of guide means such as a rail of the main body of the apparatus. The process cartridge herein integrally holds the image-developer and at least one of photoconductor, charger, light irradiator, image-transferer, separator and cleaner.

(Image Forming Apparatus and Image Forming Process)

The image forming apparatus of the present invention comprises at least a latent electrostatic image bearing member, a latent electrostatic image forming means, a developing means, a transfer means and a fixing means, and may further comprise other means, for example, a charge-eliminating means, cleaning means, recycling means and control means if required.

The image forming process of the present invention comprises at least a latent electrostatic image forming process, a developing process, a transfer process and a fixing process, and may further comprise other processes, for example, a charge-eliminating process, cleaning process, recycling process and control process if required.

The image forming process of the present invention can be suitably applied to the image forming apparatus of the present invention. The latent electrostatic image forming process can be performed by the latent electrostatic image forming means, the developing process can be performed by the developing means, the transfer process can be performed by the transfer means, and the fixing process can be performed by the fixing means. The other processes can be performed by the other means.

Latent electrostatic image forming process and latent electrostatic image forming process The latent electrostatic image forming process is a process which forms a latent electrostatic image on the latent electrostatic image bearing member.

The latent electrostatic image bearing member (hereafter, may be referred to as a "photoconducting insulator" or "photoconductor") is not particularly limited as regards material, shape, construction or size, and may be suitably selected from among those known in the art, but its shape may be that of a drum, and its material may be that of an inorganic photoconductor, such as amorphous silicon or selenium, or an organic photoconductor such as polysilane or phthalopolymethane. Among these, amorphous silicon is preferred from the viewpoint of long life.

The latent electrostatic image can be formed for example by uniformly charging the surface of the latent electrostatic image bearing member, and irradiating it imagewise, which may be performed by the latent electrostatic image forming means.

The latent electrostatic image forming means for example comprises at least a charger which uniformly charges the surface of the latent electrostatic image bearing member, and a light irradiator which exposes the surface of the latent image carrier imagewise.

The charging may for example be performed by applying a voltage to the surface of the latent electrostatic image bearing member using the charger.

The charger is not particularly limited and may be suitably selected according to the purpose, examples being contact chargers known in the art such as a conductive or semi-conductive roller, brush, film or rubber blade, and non-contact chargers using corona discharge such as a corotron or scorotron.

The light irradiation can be performed by irradiating the surface of the latent electrostatic image bearing member imagewise, for example using the light irradiator.

The light irradiator is not particularly limited and may be suitably selected according to the purpose provided that it can expose the surface of the latent electrostatic image bearing member charged by the charger in the same way as the image to be formed, for example an light irradiator such as a copy optical system, a rod lens array system, a laser optical system or a liquid crystal shutter optical system.

In addition, in the present invention, a backlight system may be employed wherein the latent electrostatic image bearing member is exposed imagewise from its rear surface.

Developing Process and Developing Means

The developing process is a process which develops the latent electrostatic image using the developer of the present invention to form a visible image.

The visible image can be formed for example by developing the latent electrostatic image using the developer of the present invention, which can be performed by the developing means.

The developing means is not particularly limited provided that it can develop an image for example by using the developer, and may be suitably selected from among those known in the art. Examples are those which comprise at least an image-developer housing the developer of the present invention, and which can supply the developer with contact or without contact to the latent electrostatic image.

The image-developer may be the dry type or wet type, and may be a monochrome image-developer or a multi-color image-developer. Examples are units comprising a stirrer which charge the developer by friction stirring, and units comprising a rotatable magnet roller.

In the image-developer, the toner and the carrier may for example be mixed and stirred together. The toner is thereby charged by friction, and forms a magnetic brush on the surface of the rotating magnet roller. As this magnet roller is arranged near the latent electrostatic image bearing member (photoconductor), part of the toner in the magnetic brush formed on the surface of this magnet roller moves to the surface of this latent electrostatic image bearing member (photoconductor) due to the force of electrical attraction. As a result, the latent electrostatic image is developed by this toner, and a visible toner image is formed on the surface of this latent electrostatic image bearing member (photoconductor).

The developer to be housed in the image-developer is a two-component developer containing the carrier of the present invention.

Transfer Process and Transfer Means

The transfer process is a process which transfers the visible image to a recording medium. In a preferred aspect, a first transfer is performed wherein, using an intermediate image-transfer member, the visible image is transferred to the intermediate image-transfer member, and a second transfer is then performed wherein this visible image is transferred to a recording medium. In a more preferred aspect, using toner of two or more colors and preferably full color toner, the primary transfer process transfers the visible image to the intermediate image-transfer member to form a compound transfer image, and the second transfer process transfers this compound transfer image to the recording medium.

The transfer can be realized for example by charging the latent electrostatic image bearing member (photoconductor) using a transfer charger, which can be performed by the transfer means. In a preferred aspect, the transfer means comprises a first transfer means which transfers the visible image to the intermediate image-transfer member to form a compound transfer image, and a second transfer means which transfers this compound transfer image to the recording medium.

The intermediate image-transfer member is not particularly limited and may be suitably selected from transfer bodies known in the art, for example, a transfer belt.

The transfer means (the first transfer means and the second transfer means), preferably comprises at least an image-transferer which charges by releasing the visible image formed on the latent electrostatic image bearing member (photo conductor) to the recording-medium side. There may be one, two or more of the transfer means.

The image-transferer may be a corona transfer unit which functions by corona discharge, a transfer belt, a transfer roller, a pressure transfer roller or an adhesion transfer unit.

The recording medium is not particularly limited and may be suitably selected from among recording media (recording papers) known in the art.

The fixing process is a process which fixes the visible image transferred to the recording medium using a fixing apparatus. This may be carried out for developer of each color transferred to the recording medium, or in one operation when the developers of each color have been laminated.

The fixing apparatus is not particularly limited and may be suitably selected from heat and pressure means known in the art. Examples of heat and pressure means are a combination of a heat roller and pressure roller, and a combination of a heat roller, pressure roller and endless belt.

The heating by the heat and pressure means is preferably heating to 80° C.–200° C.

Also, in the present invention, an optical fixing unit known in the art may be used in addition to or instead of the fixing process and fixing means, according to the purpose.

The charge-eliminating process is a process which applies a discharge bias to the latent electrostatic image bearing member to discharge it, which may be performed by a charge-eliminating means.

The charge-eliminating means is not particularly limited and may be suitably selected from charge-eliminating means known in the art provided that it can apply a discharge bias to the latent electrostatic image bearing member, for example, a discharge lamp.

The cleaning process is a process which removes electrophotographic toner remaining on the latent electrostatic image bearing member, and may be performed by a cleaning means.

The cleaning means is not particularly limited and may be suitably selected from cleaning means known in the art provided that it can remove electrophotographic toner remaining on the latent electrostatic image bearing member, for example, a magnetic brush cleaner, electrostatic brush cleaner, magnetic roller cleaner, blade cleaner, brush cleaner or web cleaner.

The recycling process is a process which makes the developing means recycle the developer removed by the cleaning process, and may be performed by a recycling means.

The recycling means is not particularly limited and may be suitably selected from among transport means known in the art.

The control means is a process which controls the processes, and may be implemented by a control means.

The control means is not particularly limited and may be suitably selected according to the purpose provided that it can control the operation of each of the means, for example, a device such as a sequencer or a computer.

The recording medium is typically plain paper, but is not specifically limited, can be selected according to the purpose and includes, for example, a polyethylene terephthalate (PET) base for overhead projector (OHP).

An embodiment of the image forming apparatus of the present invention will be illustrated with reference to FIG. 3.

Figure 3:
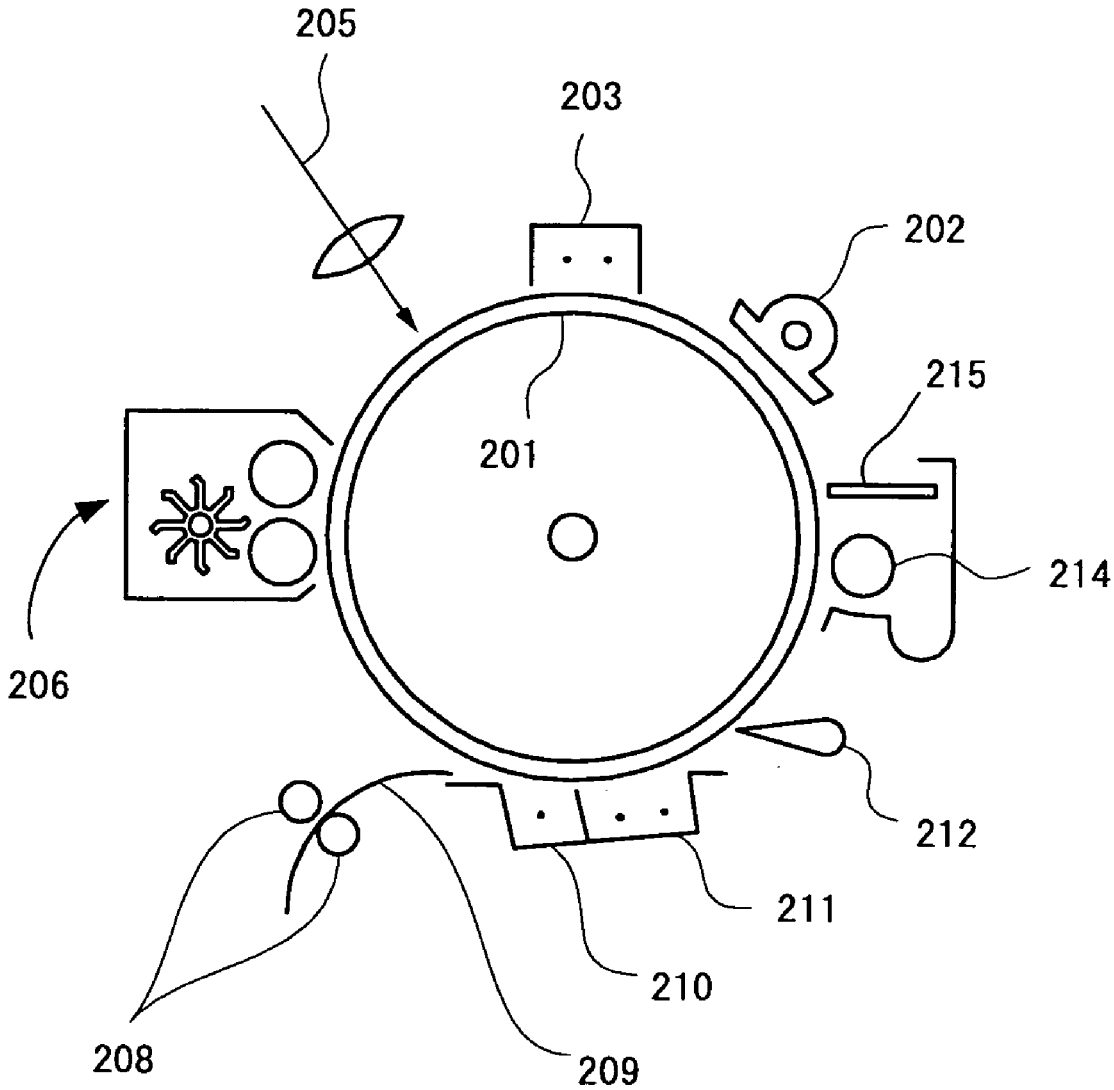
FIG. 3 is a schematic diagram of an example of an image forming apparatus as an embodiment of the present invention.

FIG. 3 is a schematic diagram for illustrating the image forming apparatus of the present invention. Modified embodiments as shown below are also encompassed within the scope of the present invention.

A photoconductor 201 serving as a latent electrostatic image bearing member comprises a substrate, and on the substrate, a single photoconductive layer or a multilayer photoconductive layer including a charge generation layer and a charge transport layer in this order. The photoconductor 201 illustrated herein is in the form of drum but may be in the form of sheet or endless belt.

An electrostatic charger 203 can be a wire charger or roller charger. For charging at high speed, a scorotron charger is preferably used. The charger electrifies the photoconductor. The photoconductor has an increasing dot reproducibility with an increasing intensity of electric field applied to the photoconductor.

A light irradiator 205 includes a light source that can yield a high luminance and can write at a high resolution of 600 dpi or more, such as a light emitting diode (LED), semiconductor laser (LD) or electroluminescent (EL) lamp.

As the image-transferer, known chargers can be used. The combination use of a transfer charger 210 and a separation charger 211 as illustrated in FIG. 3 is effective. In addition, a transfer belt and/or transfer roller can also be used. A contact device such as a transfer belt or transfer roller is preferable for reducing ozone formation. In image transfer, a voltage/current can be applied according to a constant-voltage system or constant-current system, of which a constant-current system in which the transfer charge can be held at constant stably is preferred.

An image-developer 206 has one developing sleeve, and the toner image developed on the photoconductor 201 is transferred to a transfer sheet (transfer member) 209.

The developed visible image on the photoconductor is transferred to the transfer sheet to form an image thereon by one of the following two processes. One is a process of directly transferring the developed visible image from the photoconductor to the transfer sheet as illustrated in FIG. 3, and the other is a process of transferring the developed visible image from the photoconductor to an intermediate image-transfer member and then transferring the visible image from the intermediate image-transfer member to the transfer sheet. The present invention can employ any of these processes.

Any of conventional or known transfer members can be used in the present invention, as long as it meets the configuration of the present invention.

When the photoconductor is positively (or negatively) charged and is irradiated imagewise with light, a positive (or negative) latent electrostatic image is formed thereon. By developing the latent electrostatic image with a developer (electroscopic fine particles) of negative (or positive) polarity, a positive image is formed. In contrast, by developing the image with a developer of positive (or negative) polarity, a negative image is formed.

As the light source in a charge eliminating lamp 202 and other members, any of light emitting articles can be used. Examples are fluorescent lamp, tungsten lamp, halogen lamp, mercury lamp, sodium lamp, light emitting diode (LED), semiconductor laser (LD) and electroluminescent (EL) lamp. To irradiate light of desired wavelengths alone, a filter can be used. Examples of the filter are a sharp-cut filter, band pass filter, near-infrared cut filter, dichroic filter, interference filter and color conversion filter.

The light source works to apply light to the photoconductor in the process shown in FIG. 3, as well as in another process in combination with light irradiation, such as transfer process, charge-eliminating process, cleaning process or pre-exposing process.

The charge-eliminating mechanism can be omitted when an AC component is superimposed in the charging system or when the photoconductor has a low residual potential. Instead of the optical charge elimination, an electrostatic charge eliminating mechanism such as the application of a reversed bias or the use of a grounded charge eliminating brush can be employed. FIG. 3 also illustrates a resist roller 208 and a separation blade 212.

The developer on the developed visible image on the photoconductor 201 by action of the image-developer 206 is transferred to the transfer sheet 209. A residual developer, if any, on the photoconductor 201 is removed from the photoconductor 201 by a fur brush 214 and cleaning blade 215. The cleaning process may be performed with the cleaning brush alone. Examples of the cleaning brush is a fur brush, magnetic fur brush and any other conventional brushes.

An embodiment of the image forming process of the present invention using the image forming apparatus of the present invention will be illustrated with reference to FIG. 4. The image forming apparatus 100 shown in FIG. 4 comprises a photoconductor drum 10 (hereinafter briefly referred to as "photoconductor 10") as the latent electrostatic image bearing member, a charging roller 20 as the charging means, a light irradiator 30 as the exposing means, a image-developer 40 as the developing means, an intermediate image-transfer member 50, a cleaner 60 serving as the cleaning means and having a cleaning blade, and a charge-eliminating lamp 70 as the charge-eliminating means.

Figure 4:
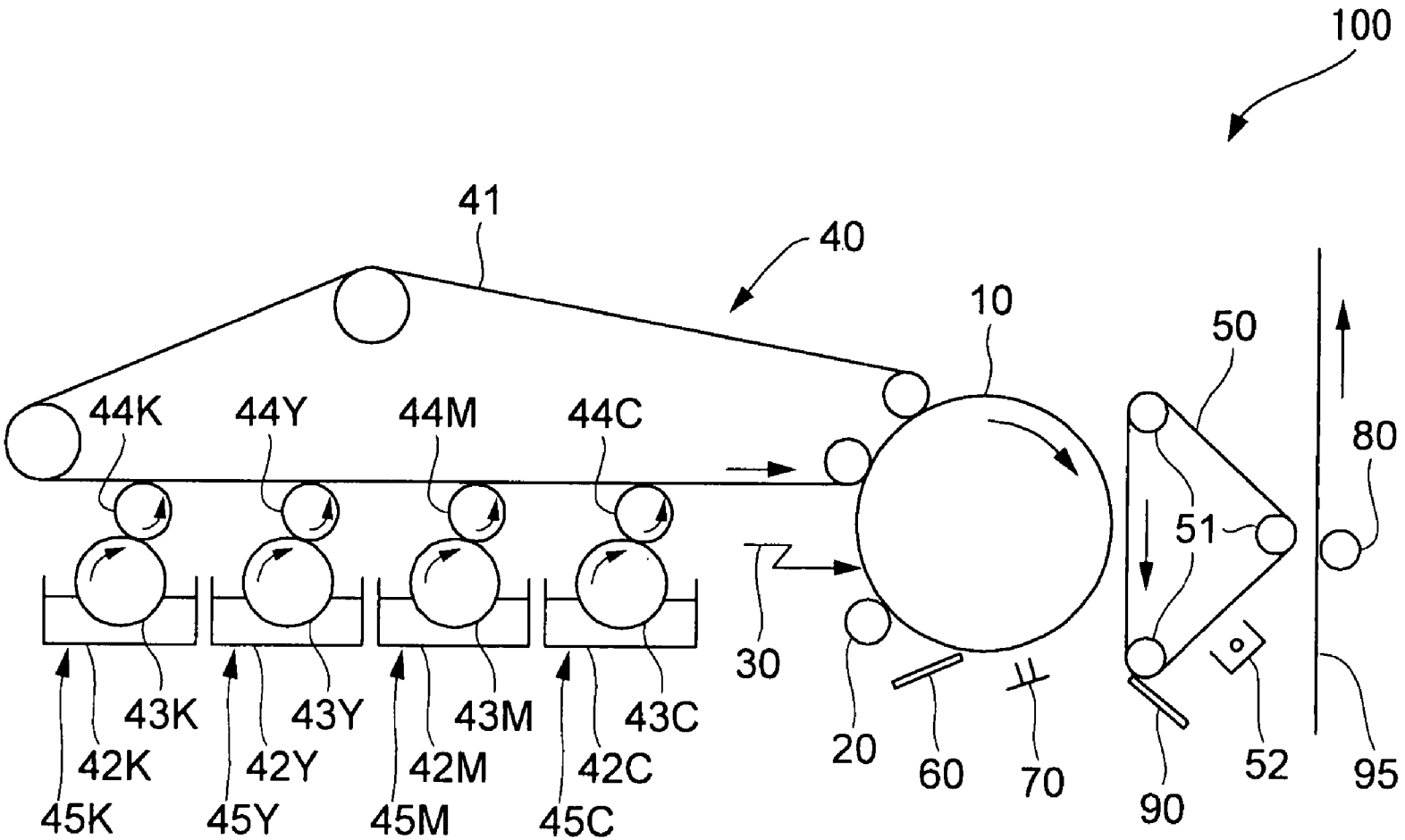
FIG. 4 is a schematic diagram of an example of an image forming process using the image forming apparatus as an embodiment of the present invention.

The intermediate image-transfer member 50 is spanned over three rollers 51 and driven in the direction indicated by an arrow in FIG. 4. One of the three rollers 51 serves as a bias roller for applying a bias for image transfer to the intermediate image-transfer member 50. A cleaner 90 for cleaning the intermediate image-transfer member 50 is arranged in the vicinity of the intermediate image transfer member 50 and includes a cleaning blade. A transfer roller 80 as the transfer means faces the intermediate image-transfer member 50 and transfers a toner image from the intermediate image-transfer member 50 to a transfer sheet 95 serving as a final transfer member. A corona charger 58 for applying charges onto the developed image on the intermediate image transfer member 50 is arranged around the intermediate image-transfer member 50. The corona charger is disposed between a contact area of the photoconductor 10 and the intermediate image transfer member 50 and another contact area of the intermediate image transfer member 50 and the transfer sheet 95 in the direction of rotation of the intermediate image transfer member 50.

The image-developer 40 includes a developer carrier implemented as an endless developing belt 41. A black developing unit 45K, a yellow developing unit 45Y, a magenta developing unit 45M and a cyan developing unit 45C are arranged side by side in the vicinity of the developing-belt 41. The black developing unit 45K includes a developer tank 42K, a developer feed roller 43K and a developing roller 44K. The yellow developing unit 45Y includes a developer tank 42Y, a developer feed roller 43Y and a developing roller 44Y. The magenta developing unit 45M includes a developer tank 42M, a developer feed roller 43M and a developing roller 44M. The cyan developing unit 45C includes a developer tank 42C, a developer feed roller 43C and a developing roller 44C. The developing belt 41 is in the form of an endless belt and is spanned over plural belt rollers rotatably, a part of which is in contact with the photoconductor 10.

In the image forming apparatus 100 shown in FIG. 4, for example, the charging roller 20 uniformly charges the photoconductor 10. The light irradiator 30 applies light to the photoconductor 10 imagewise to form a latent electrostatic image thereon. The image-developer 40 feeds the developer to the photoconductor 10 to thereby develop the latent electrostatic image thereon to form a visible image. The visible image is transferred (primary transfer) to the intermediate image transfer member 50 and then transferred (secondary transfer) to the transfer sheet 95 by action of a voltage applied by the rollers 51, to thereby form a transferred image on the transfer sheet 95. Untransferred developers on the photoconductor 10 after the transferring procedure are removed by the cleaner 60, followed by elimination of residual charges by the charge eliminating lamp 70 to be subjected to another charging procedure.

Figure 5:
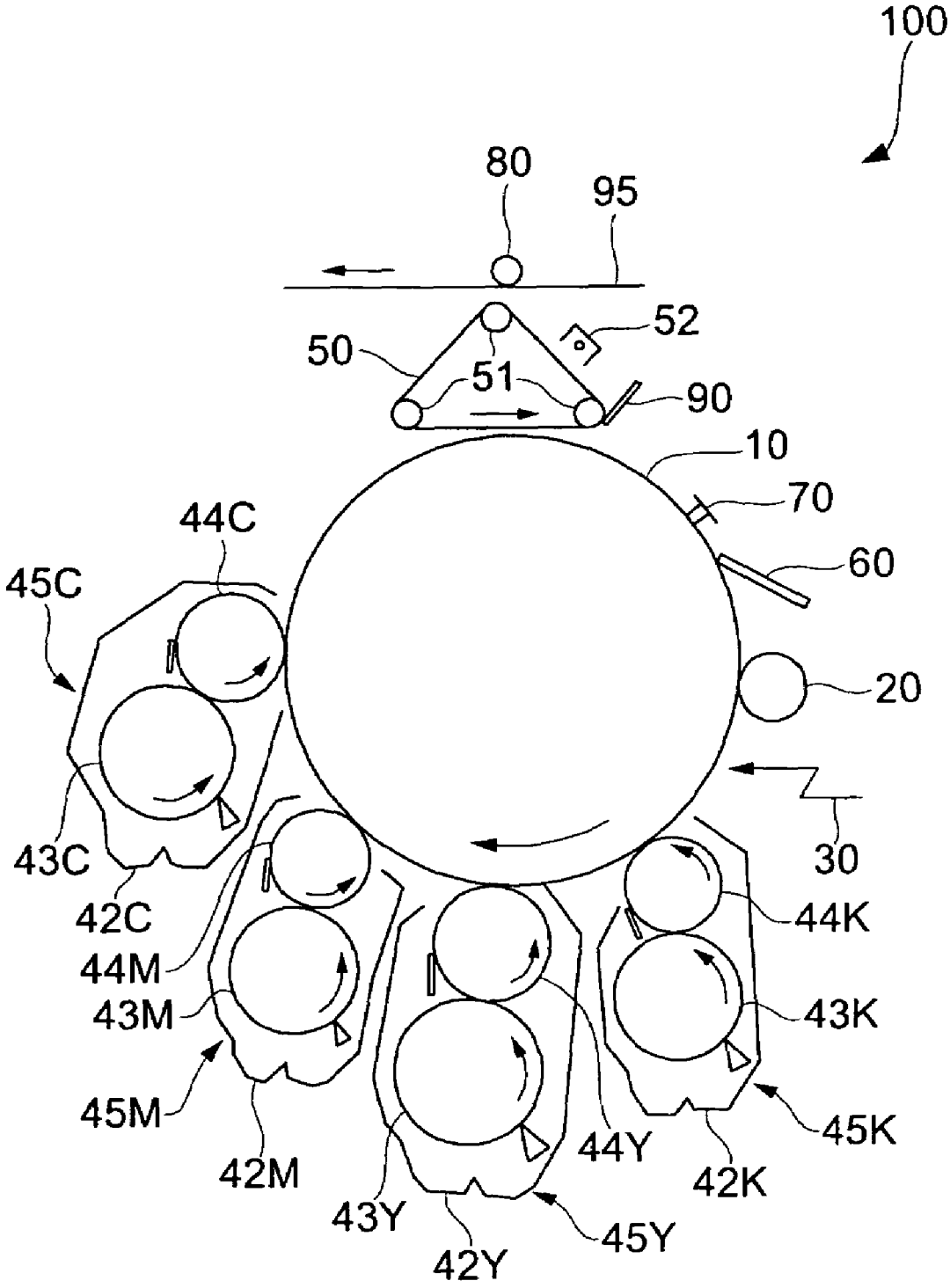
FIG. 5 is a schematic diagram of an example of an image forming process using the image forming apparatus as another embodiment of the present invention.

Another embodiment of the image forming process using the image forming apparatus will be illustrated with reference to FIG. 5. The image forming apparatus 100 of FIG. 5 has the same configuration and same advantages as in the image forming apparatus 100 of FIG. 4, except that the image forming apparatus 100 of FIG. 5 does not includes a developing belt 41, and that a black developing unit 45K, a yellow developing unit 45Y, a magenta developing unit 45M and a cyan developing unit 45C surround and directly face a photoconductor 10. The same components of FIG. 5 as those of FIG. 4 have the same reference numerals, respectively.

Figure 6:
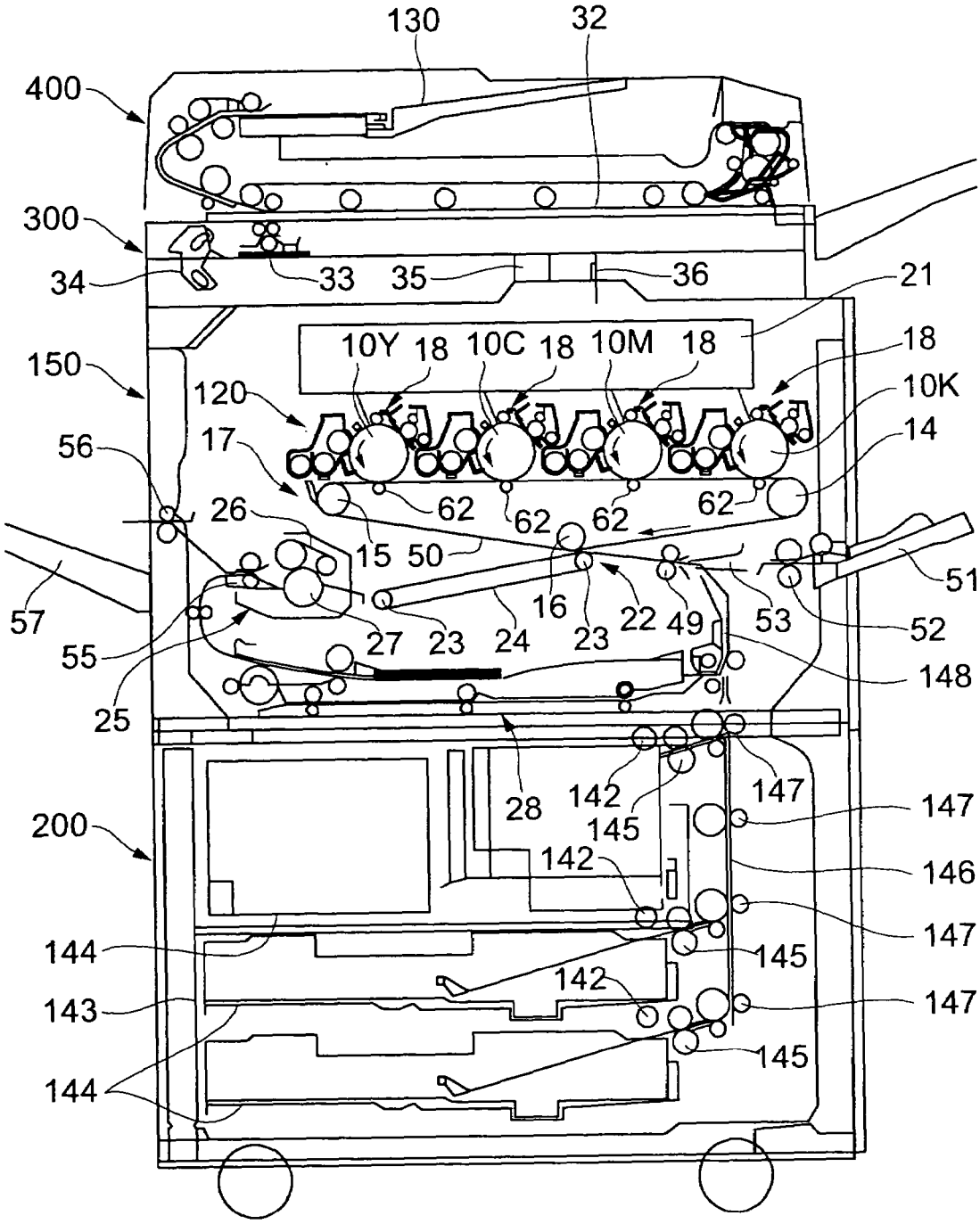
FIG. 6 is a schematic diagram of an example of an image forming process using an image forming apparatus (tandem color image forming apparatus) of the present invention, as another embodiment of the present invention.

Still another embodiment of the image forming process using the image forming apparatus will be illustrated with reference to FIG. 6. The image forming apparatus shown in FIG. 6 is a tandem color image forming apparatus which includes a copier main body 150, a feeder table 200, a scanner 300 and an automatic document feeder (ADF) 400.

The copier main body 150 includes an endless-belt intermediate image-transfer member 50 at its center part. The intermediate image-transfer member 50 is spanned over three support rollers 14, 15 and 16 and is capable of rotating and moving in a clockwise direction in FIG. 6. An intermediate image-transfer member cleaner 17 is arranged in the vicinity of the second support roller 15. The intermediate image-transfer member cleaner 17 is capable of removing a residual toner from the intermediate image-transfer member 50 after image transfer. Above the intermediate image-transfer member 50 spanned between the first and second support rollers 14 and 15, yellow, cyan, magenta and black image forming devices 18 are arrayed in parallel in a moving direction of the intermediate image-transfer member 50 to thereby constitute a tandem image forming unit 120. A light irradiator 21 is arranged in the vicinity of the tandem image forming unit 120. A secondary image-transferer 22 faces the tandem image-developer 120 with the interposition of the intermediate image transfer member 50. The secondary image-transferer 22 comprises an endless belt serving as a secondary transfer belt 24 spanned over two rollers 23. The transfer sheet transported on the secondary transfer belt 24 is capable of being in contact with the intermediate image transfer member 50. An image-fixer 25 is arranged on the side of the secondary image-transferer 22. The image-fixer 25 comprises an endless image-fixing belt 26 and a pressure roller 27 pressed on the image-fixing belt 26.

The tandem image forming apparatus further includes a sheet reverser 28 in the vicinity of the secondary image-transferer 22 and the image-fixer 25. The sheet reverser 28 is capable of reversing the transfer sheet so as to form images on both sides of the transfer sheet.

A full-color image (color copy) is formed by using the tandem image forming apparatus in the following manner. Initially, a document is placed on a document platen 130 of the automatic document feeder (ADF) 400. Alternatively, the automatic document feeder 400 is opened, the document is placed on a contact glass 32 of the scanner 300, and the automatic document feeder 400 is closed to press the document.

At the push of a start switch (not shown), the document, if any, placed on the automatic document feeder 400 is transported onto the contact glass 32. When the document is initially placed on the contact glass 32, the scanner 300 is immediately driven to operate a first carriage 33 and a second carriage 34. Light is applied from a light source to the document by action of the first carriage 33, and reflected light from the document is further reflected toward the second carriage 34. The reflected light is further reflected by a mirror of the second carriage 34 and passes through an image-forming lens 35 into a read sensor 36 to thereby read the color document (color image) and to produce black, yellow, magenta and cyan image information.

Figure 7:
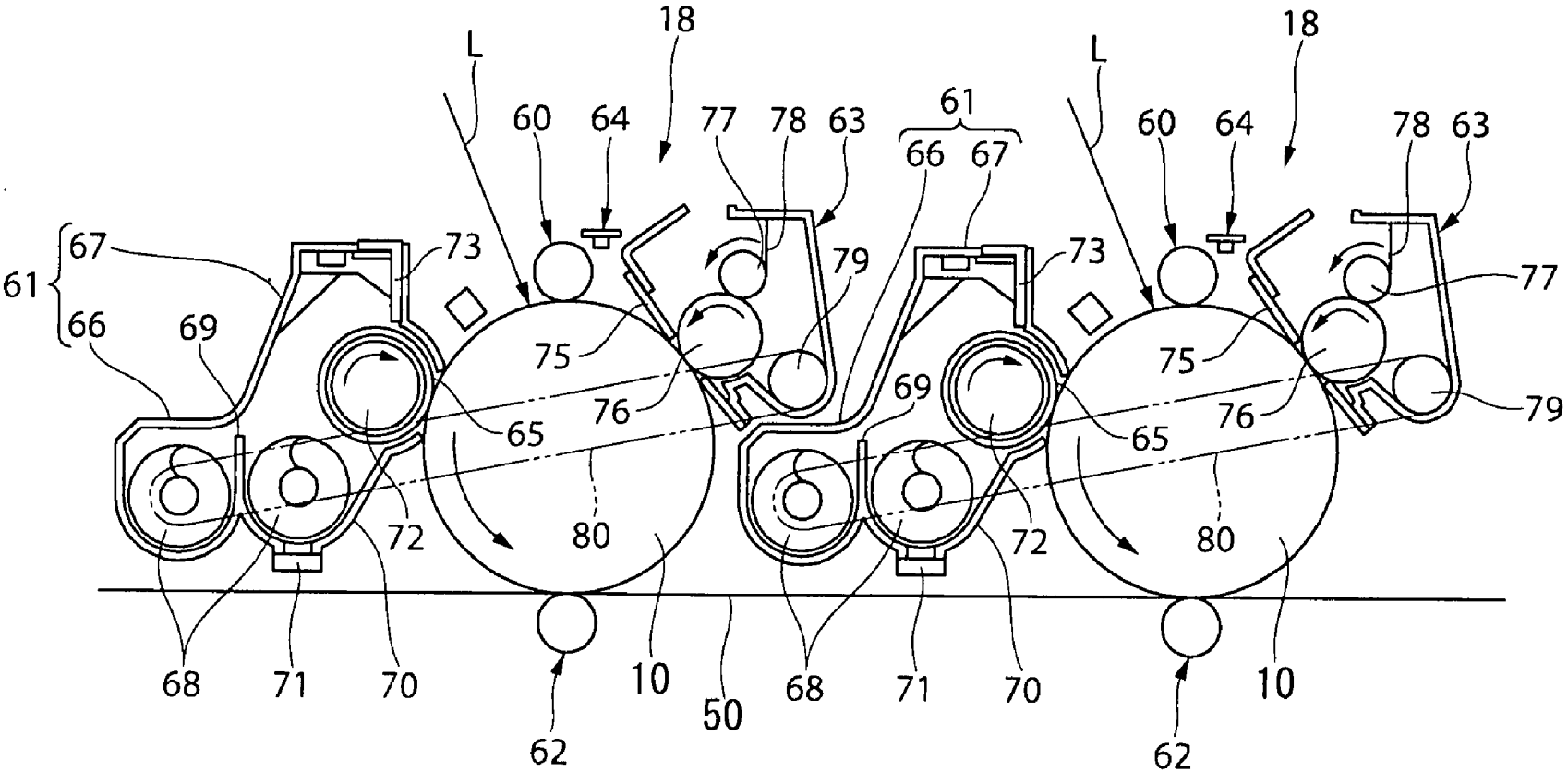
FIG. 7 is a schematic partially enlarged view of the image forming apparatus shown in FIG. 6.

Each of the black, yellow, magenta and cyan image information is transmitted to each of the image forming devices 18 (black, yellow, magenta and cyan image forming devices) in the tandem image forming apparatus to thereby form black, yellow, magenta and cyan toner images therein. More specifically with reference to FIG. 7, each of the image forming devices 18 (black, yellow, magenta and cyan image forming devices) in the tandem image forming apparatus has a photoconductor 10 (black photoconductor 10K, yellow photoconductor 10Y, magenta photoconductor 10M or cyan photoconductor 10C), an electrostatic charger 60, a light irradiator, a image-developer 61, a transfer charger 62, a photoconductor cleaner 63, and a charge-eliminator 64 and can form a monochrome image (black, yellow, magenta or cyan image) based on the color image information. The charger 60 serves to charge the photoconductor uniformly. The light irradiator applies light (L in FIG. 7) to the photoconductor color-imagewise based on each color image information to thereby form a latent electrostatic image corresponding to the color image. The image-developer 61 develops the latent electrostatic image with a color developer (black, yellow, magenta or cyan developer) to thereby form a visible image. The transfer charger 62 transfers the visible image to the intermediate image transfer member 50. The black image formed on the black photoconductor 10K, the yellow image formed on the yellow photoconductor 10Y, the magenta image formed on the magenta photoconductor 10M and the cyan image formed on the cyan photoconductor 10C are sequentially transferred (primary transfer) and superimposed onto the intermediate image transfer member 50 rotated and shifted by the support rollers 14, 15 and 16. Thus, a composite color image (transferred color image) is formed.

One of feeder rollers 142 of the feeder table 200 is selectively rotated, sheets are ejected from one of multiple feeder cassettes 144 in a paper bank 143 and are separated by a separation roller 145 one by one into a feeder path 146, are transported by a transport roller 147 into a feeder path 148 in the copier main body 150 and are bumped against a resist roller 49. Alternatively, a feeder roller 150 is rotated to eject sheets on a manual bypass tray 51, the sheets are separated one by one by a separation roller 52 into a manual bypass feeder path 53 and are bumped against the resist roller 49. The resist roller 49 is generally grounded but can be used under the application of a bias to remove paper dust of the sheets.

The resist roller 49 is rotated synchronously with the movement of the composite color image on the intermediate image-transfer member 50 to transport the sheet (recording paper) into between the intermediate image-transfer member 50 and the secondary image-transferer 22, and the composite color image is transferred onto the sheet by action of the secondary image-transferer 22 to thereby transfer the color image to the recording sheet. Separately, the intermediate image-transfer member cleaner 17 removes residual developers on the intermediate image-transfer member 50 after image transfer.

The sheet (recording sheet) bearing the transferred color image is transported by the secondary image-transferer 22 into the image-fixer 25, is applied with heat and pressure in the image-fixer 25 to fix the transferred color image. The sheet then changes its direction by action of a switch blade 55, is ejected by an ejecting roller 56 and is stacked on an output tray 57. Alternatively, the sheet changes its direction by action of the switch blade 55 into the sheet reverser 28, turns therein, is transported again to the transfer position, followed by image formation on the backside of the sheet. The sheet bearing images on both sides thereof is ejected through the ejecting roller 56 onto the output tray 57.

The present invention will be illustrated in further detail with reference to several examples and comparative examples below, which are not intended to limit the scope of the present invention.

Determination Processes (1) Shape and Surface Conditions of the Core Particle

A photograph on a field emission scanning electroscope (FE-SEM) S-4200 (trade name, available from Hitachi, Ltd.) of a sample core particle before coating was taken. The shape and surface conditions of the core particle were observed on the photograph and rated according to the following criteria. The ratings A, B and C pass, and the rating D fails the test.

A: Excellent
B: Good
C: Fair
D: Failure, not usable in practice (2) Roughness in Halftone Image A halftone image was developed and outputted using a regular image forming apparatus including a two-component image-developer, in which a latent electrostatic image was written by analogue system and was developed under the following conditions.

Distance between the photoconductor and developing sleeve: 0.35 mm

Developing nip width: 3 mm

Linear velocity of the photoconductor: 245 mm/s

Linear velocity of the developing sleeve: 515 mm/s

Voltage applied between the developing sleeve and photoconductor: A direct-current voltage superimposed with an alternating-current voltage with a frequency of 9 kHz at Vpp of 900 V The direct-current voltage and the surface potential of the photoconductor were controlled so that the density of the resulting halftone image was about 0.8. The occurrence of rough images with uneven density in the form of spot in the reproduced halftone image was rated according to the following criteria. The ratings A, B and C pass, and the rating D fails the test.

A: Excellent
B: Good
C: Fair
D: Failure, not usable in practice (3) Carrier Deposition A non-image chart was developed at a constant background potential of 150 V, the number of carrier particles deposited on the photoconductor after development was counted by observation through loupe in five fields. The carrier deposition was defined as the average number of deposited carrier particles per 100 square centimeters in the five fields and was rated according to the following criteria. The ratings A and B pass, and the rating D fails the test.

A: less than 20

B: 21 or more and equal to or less than 80

D: 81 or more (4) Reproducibility of Character Image

A character image chart with an image occupancy of 5% (each character about 2 mm wide and about 2 mm long) was outputted, and based on the image, the reproducibility of character image was rated according to the following criteria. The ratings A, B and C pass, and the rating D fails the test.

A: Excellent

B: Good

C: Fair

D: Failure, not usable in practice (5) Charge Decrease after Reproduction of 150,000 Copies A developer was prepared by mixing 95% by weight of a sample carrier and 5% by weight of a toner and charging the mixture by friction. The initial charge (Q1) of the developer before a running test was determined using a regular blow-off measuring instrument TB-200 (trade name, available from Kyocera Chemical Corp.). The developer was then mounted to a modified model of a commercially available digital full-color printer IPSiO Color 8000 (trade name, available from Ricoh Company, Limited), and 150,000 copies were reproduced. Thereafter, the toner in the developer was removed using the blow-off measuring instrument, and the charge (Q2) of the resulting carrier was determined using the blow-off measuring instrument. The charge decrease was determined by subtracting Q2 from Q1. A carrier showing a charge decrease of 5.0 μc/g or less pass the test, and one showing a charge decrease of exceeding 5.0 μc/g fails. The charge is decreased due to decrease of charging sites caused by toner spent on the carrier or flaking off of the coating layer. Thus, the charge decrease was used as an index for the toner spent and/or flaking off of the coating layer.

EXAMPLE 1

Preparation of Carrier

A resin coating composition was prepared by dispersing 30 parts by weight of a vinylidene fluoride-hexafluoropropylene copolymer and 100 parts by weight of dimethylformamide in a Homo Mixer for 10 minutes.

The resin coating composition was applied to a calcined ferrite powder as a core particle using a SPIRA COTA (registered trademark, available from Okada Seiko Co., Ltd.), dried and thereby yielded a coating layer. The calcined ferrite powder had an average particle diameter of 45 μm, a magnetic moment of 63 $Am^2/kg$ at 1 kilooersted, a content of particles with a particle diameter of 9 μm or less of 0.06% by weight, a Zr content of 0.13% by mass, a Bi content of 0% by mass, an Fe content of 25% by mass, a Mn content of 13% by mass, and a Mg content of 0.08% by mass.

The resulting carrier particles were fired in an electric furnace at 280° C. for 2 hours After cooling the ferrite bulk was cracked using a 63-μm sieve and thereby yielded Carrier 1.

Preparation of Toner

In a Henschel mixer at 800 rpm were mixed 100 parts by weight of a polyester resin having a softening point of 102° C. as a binder resin, 4 parts by weight of a microwax having a melting point of 81° C. as a wax, 2 parts by weight of fluorine-containing quaternary ammonium salt compound as a charge control agent, and 7 parts by weight of carbon black having an average particle diameter of 50 nm as a coloring agent. The mixture was melted and kneaded in a single-screw kneader Buss Co-kneader (trade name, available from Buss Co., Ltd.) with jacket-heating. The kneaded product was cooled and elongated using a cold-press machine, roughly pulverized with a cutter mill, pulverized by fine pulverizer using jet stream, and classified using an air-classifier, to yield colored matrix particles having a weight-average particle diameter of 8.44 μm and a volume-average particle diameter of 7 μm.

A total of 0.5 part by weight of colloidal silica fine particles with a degree of hydrophobing of 50% was mixed with 100 parts by weight of the colored matrix particles in a Henschel mixer at 700 rpm and thereby yielded a toner.

The weight-average particle diameter and volume-average particle diameter of the colored matrix particles were determined with a Coulter Counter TA-II available from Beckman Coulter, Inc.

The above-prepared toner was mixed with Carrier 1 in a TURBULA mixer and thereby yielded a developer having a toner concentration of 5% by weight. The developer was placed in the modified machine of the commercially available digital full-color printer IPSiO Color 8000 (trade name, available from Ricoh Company, Limited), and the roughness (irregularity in density) in halftone image, carrier deposition, reproducibility of character image and charge decrease after reproduction of 150,000 copies were determined. The results are shown in Table 1.

EXAMPLE 2

Carrier 2 was prepared by the procedure of Example 1, except for using, as a core particle, a calcined ferrite powder having an average particle diameter of 45 μm, a magnetic moment of 61 $Am^2/kg$ at 1 kilooersted, a content of particles with a particle diameter of 9 μm or less of 0.05% by weight, a Zr content of 0% by mass, a Bi content of 0.015% by mass, an Fe content of 25% by mass, a Mn content of 13% by mass, and a Mg content of 0.08% by mass.

Using Carrier 2 and the toner, a developer was prepared and the properties thereof were determined by the procedure of Example 1. The results are shown in Table 1.

EXAMPLE 3

Carrier 3 was prepared by the procedure of Example 1, except for using, as a core particle, a calcined ferrite powder having an average particle diameter of 45 μm, a magnetic moment of 67 $Am^2/kg$ at 1 kilooersted, a content of particles with a particle diameter of 9 μm or less of 0.03% by weight, a Zr content of 0.13% by mass, a Bi content of 0.015% by mass, an Fe content of 25% by mass, a Mn content of 13% by mass, and a Mg content of 0.08% by mass.

Using Carrier 3 and the toner, a developer was prepared and the properties thereof were determined by the procedure of Example 1. The results are shown in Table 1.

EXAMPLE 4

Carrier 4 was prepared by the procedure of Example 1, except for using, as a core particle, a calcined ferrite powder having an average particle diameter of 45 μm, a magnetic moment of 75 $Am^2/kg$ at 1 kilooersted, a content of particles with a particle diameter of 9 μm or less of 0.02% by weight, a Zr content of 0.13% by mass, a Bi content of 0.015% by mass, an Fe content of 25% by mass, a Mn content of 13% by mass, and a Mg content of 0.25% by mass.

Using Carrier 4 and the toner, a developer was prepared and the properties thereof were determined by the procedure of Example 1. The results are shown in Table 1.

EXAMPLE 5

Carrier 5 was prepared by the procedure of Example 1, except for using, as a core particle, a calcined ferrite powder having an average particle diameter of 19 μm, a magnetic moment of 74 Am2/kg at 1 kilooersted, a content of particles with a particle diameter of 9 μm or less of 1.20% by weight, a Zr content of 0.13% by mass, a Bi content of 0.015% by mass, an Fe content of 25% by mass, a Mn content of 13% by mass, and a Mg content of 0.25% by mass and using a 22-μm sieve for cracking.

Using Carrier 5 and the toner, a developer was prepared and the properties thereof were determined by the procedure of Example 1. The results are shown in Table 1.

EXAMPLE 6

Carrier 6 was prepared by the procedure of Example 1, except for using, as a core particle, a calcined ferrite powder having an average particle diameter of 45 μm, a magnetic moment of 75 $Am^2$/kg at 1 kilooersted, a content of particles with a particle diameter of 9 μm or less of 3.40% by weight, a Zr content of 0.14% by mass, a Bi content of 0.016% by mass, an Fe content of 25% by mass, a Mn content of 13% by mass, and a Mg content of 0.25% by mass.

Using Carrier 6 and the toner, a developer was prepared and the properties thereof were determined by the procedure of Example 1. The results are shown in Table 1.

EXAMPLE 7

Carrier 7 was prepared by the procedure of Example 1, except for using, as a core particle, a calcined ferrite powder having an average particle diameter of 45 μm, a magnetic moment of 38 $Am^2$/kg at 1 kilooersted, a content of particles with a particle diameter of 9 μm or less of 0.04% by weight, a Zr content of 0.13% by mass, a Bi content of 0.014% by mass, an Fe content of 41% by mass, a Mn content of 5% by mass, and a Mg content of 0.07% by mass.

Using Carrier 7 and the toner, a developer was prepared and the properties thereof were determined by the procedure of Example 1. The results are shown in Table 1.

EXAMPLE 8

Carrier 8 was prepared by the procedure of Example 1, except for using, as a core particle, a calcined ferrite powder having an average particle diameter of 45 μm, a magnetic moment of 92 $Am^2$/kg at 1 kilooersted, a content of particles with a particle diameter of 9 μm or less of 0.05% by weight, a Zr content of 0.13% by mass, a Bi content of 0.015% by mass, an Fe content of 20% by mass, a Mn content of 20% by mass, and a Mg content of 0.30% by mass.

Using Carrier 8 and the toner, a developer was prepared and the properties thereof were determined by the procedure of Example 1. The results are shown in Table 1.

EXAMPLE 9

Carrier 9 was prepared by the procedure of Example 4, except for using a resin coating composition prepared in the following manner.

Preparation of Resin Coating Composition

The resin coating composition was prepared by dispersing 132.2 parts by weight of a silicone resin solution SR2410 (trade name, available from Dow Corning Toray Silicone Co., Ltd.; solid content: 23% by weight), 0.66 part by weight of an aminosilane SH6020 (trade name, available from Dow Corning Toray Silicone Co., Ltd.; solid content: 100% by weight), 7 parts by weight of carbon black having an average particle diameter of 50 nm as a coloring agent and 300 parts by weight of toluene in a Homo Mixer for 10 minutes.

Using Carrier 9 and the toner, a developer was prepared and the properties thereof were determined by the procedure of Example 1. The results are shown in Table 1.

EXAMPLE 10

Carrier 10 was prepared by the procedure of Example 4, except for using a resin coating composition prepared in the following manner.

Preparation of Resin Coating Composition

The resin coating composition was prepared by dispersing 42.0 parts by weight of an acrylic resin solution (solid content: 50% by weight), 13.0 parts by weight of a guanamine solution (solid content: 70% by weight), 7 parts by weight of a carbon black having an average particle diameter of 50 nm as a coloring agent, 60 parts by weight of toluene and 60 parts by weight of butyl cellosolve in a Homo Mixer for 10 minutes.

Using Carrier 10 and the toner, a developer was prepared and the properties thereof were determined by the procedure of Example 1. The results are shown in Table 1.

EXAMPLE 11

Carrier 11 was prepared by the procedure of Example 4, except for using a resin coating composition prepared in the following manner.

Preparation of Resin Coating Composition

The resin coating composition was prepared by dispersing 66.1 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 21.0 parts by weight of an acrylic resin solution (solid content: 50% by weight), 6.5 parts by weight of a guanamine solution (solid content: 70% by weight), 7 parts by weight of carbon black having an average particle diameter of 50 nm as a coloring agent, 180 parts by weight of toluene and 30 parts by weight of butyl cellosolve in a Homo Mixer for 10 minutes.

Using Carrier 11 and the toner, a developer was prepared and the properties thereof were determined by the procedure of Example 1. The results are shown in Table 1.

EXAMPLE 12

Carrier 12 was prepared by the procedure of Example 11, except for using, as a core particle, a calcined ferrite powder having an average particle diameter of 35 μm, a magnetic moment of 74 $Am^2$/kg at 1 kilooersted, a content of particles with a particle diameter of 9 μm or less of 0.01% by weight, a Zr content of 0.13% by mass, a Bi content of 0.015% by mass, an Fe content of 25% by mass, a Mn content of 13% by mass, and a Mg content of 0.25% by mass and using a resin coating composition prepared in the following manner.

Preparation of Resin Coating Composition

The resin coating composition was prepared by dispersing 85.0 parts by weight of a silicone resin solution SR2410 (trade name, available from Dow Corning Toray Silicone Co., Ltd.; solid content: 23% by weight), 0.42 part by weight of an aminosilane SH6020 (trade name, available from Dow Corning Toray Silicone Co., Ltd.; solid content: 100% by weight), 27.0 parts by weight of an acrylic resin solution (solid content: 50% by weight), 8.4 parts by weight of a guanamine solution (solid content: 70% by weight), 9 parts by weight of carbon black having an average particle diameter of 50 nm as a coloring agent, 230 parts by weight of toluene and 40 parts by weight of butyl cellosolve in a Homo Mixer for 10 minutes.

Using Carrier 12 and the toner, a developer was prepared and the properties thereof were determined by the procedure of Example 1. The results are shown in Table 1.

EXAMPLE 13

Carrier 13 was prepared by the procedure of Example 4, except for using a resin coating composition prepared in the following manner.

Preparation of Resin Coating Composition

The resin coating composition was prepared by dispersing 123.9 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 3.0 parts by weight of an acrylic resin solution (solid content: 50% by weight), 0.65 parts by weight of a guanamine solution (solid content: 70% by weight), 7 parts by weight of carbon black having an average particle diameter of 50 nm as a coloring agent, 180 parts by weight of toluene and 30 parts by weight of butyl cellosolve in a Homo Mixer for 10 minutes.

Using Carrier 13 and the toner, a developer was prepared and the properties thereof were determined by the procedure of Example 1. The results are shown in Table 1.

EXAMPLE 14

Carrier 14 was prepared by the procedure of Example 4, except for using a resin coating composition prepared in the following manner.

Preparation of Resin Coating Composition

The resin coating composition was prepared by dispersing 6.5 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 57.0 parts by weight of an acrylic resin solution (solid content: 50% by weight), 12.4 parts by weight of a guanamine solution (solid content: 70% by weight), 7 parts by weight of carbon black having an average particle diameter of 50 nm as a coloring agent, 80 parts by weight of toluene and 30 parts by weight of butyl cellosolve in a Homo Mixer for 10 minutes.

Using Carrier 14 and the toner, a developer was prepared and the properties thereof were determined by the procedure of Example 1. The results are shown in Table 1.

EXAMPLE 15

Carrier 15 was prepared by the procedure of Example 4, except for using a resin coating composition prepared in the following manner.

Preparation of Resin Coating Composition for Lower Coating Layer

The resin coating composition was prepared by dispersing 21.0 parts by weight of an acrylic resin solution (solid content: 50% by weight), 6.5 parts by weight of a guanamine solution (solid content: 70% by weight), 7 parts by weight of a carbon black having an average particle diameter of 50 nm as a coloring agent, 30 parts by weight of toluene and 30 parts by weight of butyl cellosolve in a Homo Mixer for 10 minutes.

Using the same core particle as in Example 4, the resin coating composition was applied to the core particle using a SPIRA COTA (registered trademark, available from Okada Seiko Co., Ltd.), was dried and thereby yielded an intermediate carrier having a lower coating layer.

Preparation of Resin Coating Composition for Upper Coating Layer

A resin coating composition was prepared by dispersing 66.1 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight) and 150 parts by weight of toluene in a Homo Mixer for 10 minutes. The resin coating composition was applied to the intermediate carrier, was dried and thereby yielded an upper coating layer thereon.

The carrier having two-layer coating structure was fired in an electric furnace at 180° C. for 1 hour. After cooling the ferrite powder bulk was cracked using a 63-μm sieve and thereby yielded Carrier 15.

Using Carrier 15 and the toner, a developer was prepared and the properties thereof were determined by the procedure of Example 1. The results are shown in Table 1.

COMPARATIVE EXAMPLE 1

Carrier 16 was prepared by the procedure of Example 1, except for using, as a core particle, a calcined ferrite powder having an average particle diameter of 45 μm, a magnetic moment of 65 $Am^2/kg$ at 1 kilooersted, a content of particles with a particle diameter of 9 μm or less of 0.06% by weight, a Zr content of 0% by mass, a Bi content of 0% by mass, an Fe content of 25% by mass, a Mn content of 13% by mass, and a Mg content of 0.08% by mass.

Using Carrier 16 and the toner, a developer was prepared and the properties thereof were determined by the procedure of Example 1. The results are shown in Table 1.

COMPARATIVE EXAMPLE 2

Carrier 17 was prepared by the procedure of Example 1, except for using, as a core particle, a calcined ferrite powder having an average particle diameter of 45 μm, a magnetic moment of 58 $Am^2/kg$ at 1 kilooersted, a content of particles with a particle diameter of 9 μm or less of 0.05% by weight, a Zr content of 8% by mass, a Bi content of 0% by mass, an Fe content of 12% by mass, a Mn content of 25% by mass, and a Mg content of 0.08% by mass.

Using Carrier 17 and the toner, a developer was prepared and the properties thereof were determined by the procedure of Example 1. The results are shown in Table 1.

COMPARATIVE EXAMPLE 3

Carrier 18 was prepared by the procedure of Example 1, except for using, as a core particle, a calcined ferrite powder having an average particle diameter of 45 μm, a magnetic moment of 57 $Am^2/kg$ at 1 kilooersted, a content of particles with a particle diameter of 9 μm or less of 0.05% by weight, a Zr content of 0% by mass, a Bi content of 3% by mass, an Fe content of 13% by mass, a Mn content of 25% by mass, and a Mg content of 0.08% by mass.

Using Carrier 18 and the toner, a developer was prepared and the properties thereof were determined by the procedure of Example 1. The results are shown in Table 1.

TABLE 1

| | Roughness in halftone image | Carrier deposition | Reproducibility of character image | Charge decrease (μc/g) |
|---|---|---|---|---|
| Example 1 | B | A | A | 4.2 |
| Example 2 | B | A | A | 4.3 |
| Example 3 | B | A | A | 4.0 |
| Example 4 | B | A | A | 4.1 |
| Example 5 | B | B | A | 4.2 |
| Example 6 | B | B | A | 4.1 |
| Example 7 | B | B | A | 4.7 |
| Example 8 | B | A | B | 4.8 |
| Example 9 | B | A | A | 2.6 |
| Example 10 | B | A | A | 3.0 |
| Example 11 | B | A | A | 1.9 |
| Example 12 | B | A | A | 2.3 |
| Example 13 | B | A | A | 2.7 |
| Example 14 | B | A | A | 2.9 |
| Example 15 | B | A | A | 1.2 |
| Comp. Ex. 1 | D | | not determined | |
| Comp. Ex. 2 | D | | not determined | |
| Comp. Ex. 3 | D | | not determined | |

Carriers 1 to 15 (Examples 1 to 15) showed satisfactory properties, all of which passed in the tests.

Carriers 16 to 18 (Comparative Examples 1 to 3) showed roughness (irregular densities) in halftone images were not usable in practice, failed the test, and the other properties were not determined.

EXAMPLE 16

Carrier 19 was prepared in the following manner.

In a Homo Mixer were dispersed 30 parts by weight of a vinylidene fluoride-hexafluoropropylene copolymer and 100 parts by weight of dimethylformamide for 10 minutes and thereby yielded a resin coating composition. The resin coating composition was applied to a core particle using a SPIRA COTA (registered trademark, available from Okada Seiko Co., Ltd.), was dried and thereby yielded a coating layer. The core particle used herein was a calcined ferrite powder having an average particle diameter of 45 μm and mainly comprising Fe, Mn, Mg and Zr. The resulting carrier particles were fired in an electric furnace at 280° C. for 2 hours. After cooling, the ferrite powder bulk was cracked using a 63-μm sieve and thereby yielded Carrier 19. Carrier 19 had an average particle diameter of 45 μm, a magnetic moment of 63 $Am^2/kg$ at 1 kilooersted, a content of particles with a particle diameter of 9 μm or less of 0.05% by weight, a Zr content of 0.12% by mass, a Bi content of 0% by mass, an Fe content of 25% by mass, a Mn content of 14% by mass, and a Mg content of 0.07% by mass.

A toner for use herein was prepared in the following manner.

In a Henschel mixer at 800 rpm were mixed 100 parts by weight of a polyester resin having a softening point of 102° C. as a binder resin, 4 parts by weight of a microwax having a melting point of 81° C. as a wax, 2 parts by weight of a fluorine-containing quaternary ammonium salt compound as a charge control agent, and 7 parts by weight of carbon black having an average particle diameter of 50 nm as a coloring agent. The mixture was melted and kneaded in a single-screw kneader Buss Co-kneader (trade name, available from Buss Co., Ltd.) with jacket-heating. The kneaded product was cooled and elongated using a cold-press machine, roughly pulverized with a cutter mill, pulverized by fine pulverizer using jet stream, and classified using an air-classifier, to yield colored matrix particles having a weight-average particle diameter of 8.42 μm and a volume-average particle diameter of 7 μm. A total of 0.5 part by weight of colloidal silica fine particles with a degree of hydrophobing of 50% was mixed with 100 parts by weight of the colored matrix particles in a Henschel mixer at 700 rpm and thereby yielded the toner.

The weight-average particle diameter and volume-average particle diameter of the colored matrix particles were determined with a Coulter Counter TA-II available from Beckman Coulter, Inc.

The shape and surface conditions of above-prepared Carrier 19 were evaluated. In addition, Carrier 19 and the above-prepared toner were mixed in a TURBULA Mixer and thereby yielded a developer having a toner concentration of 5% by weight. The developer was placed in the modified machine of the commercially available digital full-color printer IPSiO Color 8000 (trade name, available from Ricoh Company, Limited), and the roughness in halftone image, carrier deposition, reproducibility of character image and charge decrease after reproduction of 150,000 copies were determined. The results are shown in Table 2.

EXAMPLE 17

Carrier 20 was prepared by the procedure of Example 16, except for using, as a core particle, a calcined ferrite powder having an average particle diameter of 45 μm and mainly comprising Fe, Mn, Mg and Bi. Carrier 20 had an average particle diameter of 45 μm, a magnetic moment of 60 $Am^2/kg$ at 1 kilooersted, a content of particles with a particle diameter of 9 μm or less of 0.05% by weight, a Zr content of 0% by mass, a Bi content of 0.016% by mass, an Fe content of 25% by mass, a Mn content of 13% by mass, and a Mg content of 0.06% by mass. Using Carrier 20 and the toner, a developer was prepared and the properties thereof were determined by the procedure of Example 16. The results are shown in Table 2.

EXAMPLE 18

Carrier 21 was prepared by the procedure of Example 16, except for using, as a core particle, a calcined ferrite powder having an average particle diameter of 45 μm and mainly comprising Fe, Mn, Mg and Bi. Carrier 21 had an average particle diameter of 45 μm, a magnetic moment of 67 $Am^2/kg$ at 1 kilooersted, a content of particles with a particle diameter of 9 μm or less of 0.02% by weight, a Zr content of 0.13% by mass, a Bi content of 0.015% by mass, an Fe content of 25% by mass, a Mn content of 13% by mass, and a Mg content of 0.06% by mass. Using Carrier 21 and the toner, a developer was prepared and the properties thereof were determined by the procedure of Example 16. The results are shown in Table 2.

EXAMPLE 19

Carrier 22 was prepared by the procedure of Example 16, except for using, as a core particle, a calcined ferrite powder containing Mg in a larger amount. Carrier 22 had an average particle diameter of 45 μm, a magnetic moment of 76 $Am^2/kg$ at 1 kilooersted, a content of particles with a particle diameter of 9 μm or less of 0.03% by weight, a Zr content of 0.12% by mass, a Bi content of 0.016% by mass, an Fe content of 25% by mass, a Mn content of 14% by mass, and a Mg content of 0.20% by mass. Using Carrier 22 and the toner, a developer was prepared and the properties thereof were determined by the procedure of Example 16. The results are shown in Table 2.

EXAMPLE 20

Carrier 23 was prepared by the procedure of Example 16, except for using, as a core particle, a calcined ferrite powder having a smaller average particle diameter of 19 μm and using a 22-μm sieve in cracking. Carrier 23 had an average particle diameter of 19 μm, a magnetic moment of 75 $Am^2/kg$ at 1 kilooersted, a content of particles with a particle diameter of 9 μm or less of 1.30% by weight, a Zr content of 0.12% by mass, a Bi content of 0.016% by mass, an Fe content of 25% by mass, a Mn content of 13% by mass, and a Mg content of 0.19% by mass. Using Carrier 23 and the toner, a developer was prepared and the properties thereof were determined by the procedure of Example 16. The results are shown in Table 2.

EXAMPLE 21

Carrier 24 was prepared by the procedure of Example 16, except for using, as a core particle, a calcined ferrite powder containing particles with a small particle diameter in a larger amount. Carrier 24 had an average particle diameter of 45 μm, a magnetic moment of 75 $Am^2/kg$ at 1 kilooersted, a content of particles with a particle diameter of 9 μm or less of 3.30% by weight, a Zr content of 0.13% by mass, a Bi content of 0.016% by mass, an Fe content of 25% by mass, a Mn content of 13% by mass, and a Mg content of 0.19% by mass. Using Carrier 24 and the toner, a developer was prepared and the properties thereof were determined by the procedure of Example 16. The results are shown in Table 2.

EXAMPLE 22

Carrier 25 was prepared by the procedure of Example 16, except for using, as a core particle, a calcined ferrite powder comprising principal elements in different amounts and having a lower magnetic moment. Carrier 25 had an average particle diameter of 45 μm, a magnetic moment of 37 $Am^2/kg$ at 1 kilooersted, a content of particles with a particle diameter of 9 μm or less of 0.05% by weight, a Zr content of 0.13% by mass, a Bi content of 0.016% by mass, an Fe content of 39% by mass, a Mn content of 5% by mass, and a Mg content of 0.08% by mass. Using Carrier 25 and the toner, a developer was prepared and the properties thereof were determined by the procedure of Example 16. The results are shown in Table 2.

EXAMPLE 23

Carrier 26 was prepared by the procedure of Example 16, except for using, as a core particle, a calcined ferrite powder comprising principal elements in different amounts and having a higher magnetic moment. Carrier 26 had an average particle diameter of 45 μm, a magnetic moment of 93 $Am^2/kg$ at 1 kilooersted, a content of particles with a particle diameter of 9 μm or less of 0.04% by weight, a Zr content of 0.12% by mass, a Bi content of 0.015% by mass, an Fe content of 21% by mass, a Mn content of 19% by mass, and a Mg content of 0.26% by mass. Using Carrier 26 and the toner, a developer was prepared and the properties thereof were determined by the procedure of Example 16. The results are shown in Table 2.

EXAMPLE 24

Carrier 27 was prepared by the procedure of Example 19, except for using a resin coating composition comprising 132.2 parts by weight of a silicone resin solution SR2410 (trade name, available from Dow Corning Toray Silicone Co., Ltd.; solid content: 23% by weight), 0.66 part by weight of an aminosilane SH6020 (trade name, available from Dow Corning Toray Silicone Co., Ltd.; solid content: 100% by weight), 7 parts by weight of carbon black having an average particle diameter of 50 nm as a coloring agent and 300 parts by weight of toluene. Carrier 27 had an average particle diameter of 45 μm, a magnetic moment of 76 $Am^2/kg$ at 1 kilooersted, a content of particles with a particle diameter of 9 μm or less of 0.03% by weight, a Zr content of 0.12% by mass, a Bi content of 0.015% by mass, an Fe content of 25% by mass, a Mn content of 13% by mass, and a Mg content of 0.20% by mass. Using Carrier 27 and the toner, a developer was prepared and the properties thereof were determined by the procedure of Example 16. The results are shown in Table 2.

EXAMPLE 25

Carrier 28 was prepared by the procedure of Example 19, except for using a resin coating composition comprising 42.0 parts by weight of an acrylic resin solution (solid content: 50% by weight), 13.0 parts by weight of a guanamine solution (solid content: 70% by weight), 7 parts by weight of a carbon black having an average particle diameter of 50 nm as a coloring agent, 60 parts by weight of toluene and 60 parts by weight of butyl cellosolve. Carrier 28 had an average particle diameter of 45 μm, a magnetic moment of 75 $Am^2/kg$ at 1 kilooersted, a content of particles with a particle diameter of 9 μm or less of 0.02% by weight, a Zr content of 0.12% by mass, a Bi content of 0.015% by mass, an Fe content of 25% by mass, a Mn content of 14% by mass, and a Mg content of 0.19% by mass. Using Carrier 28 and the toner, a developer was prepared and the properties thereof were determined by the procedure of Example 16. The results are shown in Table 2.

EXAMPLE 26

Carrier 29 was prepared by the procedure of Example 19, except for using a resin coating composition comprising 66.1 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 21.0 parts by weight of an acrylic resin solution (solid content: 50% by weight), 6.5 parts by weight of a guanamine solution (solid content: 70% by weight), 7 parts by weight of carbon black having an average particle diameter of 50 nm as a coloring agent, 180 parts by weight of toluene and 30 parts by weight of butyl cellosolve. Carrier 29 had an average particle diameter of 45 μm, a magnetic moment of 76 $Am^2/kg$ at 1 kilooersted, a content of particles with a particle diameter of 9 μm or less of 0.03% by weight, a Zr content of 0.13% by mass, a Bi content of 0.016% by mass, an Fe content of 25% by mass, a Mn content of 14% by mass, and a Mg content of 0.19% by mass. Using Carrier 29 and the toner, a developer was prepared and the properties thereof were determined by the procedure of Example 16. The results are shown in Table 2.

EXAMPLE 27

Carrier 30 was prepared by the procedure of Example 26, except for using, as a core particle, a calcined ferrite powder having a smaller average particle diameter and using a coating resin composition comprising 85.0 parts by weight of a silicone resin solution SR2410 (trade name, available from Dow Corning Toray Silicone Co., Ltd.; solid content: 23% by weight), 0.42 part by weight of an aminosilane SH6020 (trade name, available from Dow Corning Toray Silicone Co., Ltd.; solid content: 100% by weight), 27.0 parts by weight of an acrylic resin solution (solid content: 50% by weight), 8.4 parts by weight of a guanamine solution (solid content: 70% by weight), 9 parts by weight of carbon black having an average particle diameter of 50 nm as a coloring agent, 230 parts by weight of toluene and 40 parts by weight of butyl cellosolve. Carrier 30 had an average particle diameter of 35 μm, a magnetic moment of 75 $Am^2/kg$ at 1 kilooersted, a content of particles with a particle diameter of 9 μm or less of 0.11% by weight, a Zr content of 0.12% by mass, a Bi content of 0.015% by mass, an Fe content of 25% by mass, a Mn content of 14% by mass, and a Mg content of 0.20% by mass. Using Carrier 30 and the toner, a developer was prepared and the properties thereof were determined by the procedure of Example 16. The results are shown in Table 2.

EXAMPLE 28

Carrier 31 was prepared by the procedure of Example 19, except for using a resin coating composition comprising 123.9 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Coming Toray Silicone Co., Ltd.; solid content: 100% by weight), 3.0 parts by weight of an acrylic resin solution (solid content: 50% by weight), 0.65 parts by weight of a guanamine solution (solid content: 70% by weight), 7 parts by weight of carbon black having an average particle diameter of 50 nm as a coloring agent, 180 parts by weight of toluene and 30 parts by weight of butyl cellosolve. Carrier 31 had an average particle diameter of 45 μm, a magnetic moment of 75 $Am^2/kg$ at 1 kilooersted, a content of particles with a particle diameter of 9 μm or less of 0.03% by weight, a Zr content of 0.13% by mass, a Bi content of 0.015% by mass, an Fe content of 25% by mass, a Mn content of 13% by mass, and a Mg content of 0.19% by mass. Using Carrier 31 and the toner, a developer was prepared and the properties thereof were determined by the procedure of Example 16. The results are shown in Table 2.

EXAMPLE 29

Carrier 32 was prepared by the procedure of Example 19, except for using a resin coating composition comprising 6.5 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 57.0 parts by weight of an acrylic resin solution (solid content: 50% by weight), 12.4 parts by weight of a guanamine solution (solid content: 70% by weight), 7 parts by weight of carbon black having an average particle diameter of 50 nm as a coloring agent, 80 parts by weight of toluene and 30 parts by weight of butyl cellosolve. Carrier 32 had an average particle diameter of 45 μm, a magnetic moment of 76 $Am^2/kg$ at 1 kilooersted, a content of particles with a particle diameter of 9 μm or less of 0.02% by weight, a Zr content of 0.12% by mass, a Bi content of 0.016% by mass, an Fe content of 25% by mass, a Mn content of 13% by mass, and a Mg content of 0.20% by mass. Using Carrier 32 and the toner, a developer was prepared and the properties thereof were determined by the procedure of Example 16. The results are shown in Table 2.

EXAMPLE 30

Carrier 33 was prepared by the procedure of Example 19, except for employing the following procedures.

Initially, a resin coating composition for lower coating layer was prepared by dispersing 21.0 parts by weight of an acrylic resin solution (solid content: 50% by weight), 6.5 parts by weight of a guanamine solution (solid content: 70% by weight), 7 parts by weight of carbon black having an average particle diameter of 50 nm as a coloring agent, 30 parts by weight of toluene and 30 parts by weight of butyl cellosolve in a Homo Mixer for 10 minutes. Using the same core particle as in Example 19, the resin coating composition was applied to the core particle using a SPIRA COTA (registered trademark, available from Okada Seiko Co., Ltd.), was dried and thereby yielded an intermediate carrier having a lower coating layer.

A resin coating composition for upper coating layer was prepared by dispersing 66.1 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight) and 150 parts by weight of toluene in a Homo Mixer for 10 minutes. The resin coating composition was applied to the intermediate carrier, was dried and thereby yielded an upper coating layer thereon. The carrier having two-layer coating structure was fired in an electric furnace at 180° C. for 1 hour. After cooling, the ferrite powder bulk was cracked using a 63-μm sieve and thereby yielded Carrier 33. Carrier 33 had an average particle diameter of 45 μm, a magnetic moment of 76 $Am^2/kg$ at 1 kilooersted, a content of particles with a particle diameter of 9 μm or less of 0.02% by weight, a Zr content of 0.12% by mass, a Bi content of 0.015% by mass, an Fe content of 25% by mass, a Mn content of 13% by mass, and a Mg content of 0.20% by mass. Using Carrier 33 and the toner, a developer was prepared and the properties thereof were determined by the procedure of Example 16. The results are shown in Table 2.

COMPARATIVE EXAMPLE 4

Carrier 34 was prepared by the procedure of Example 16, except for using, as a core particle, a calcined ferrite power containing no Zr. Carrier 34 had an average particle diameter of 45 μm, a magnetic moment of 64 $Am^2/kg$ at 1 kilooersted, a content of particles with a particle diameter of 9 μm or less of 0.05% by weight, a Zr content of 0% by mass, a Bi content of 0% by mass, an Fe content of 25% by mass, a Mn content of 13% by mass, and a Mg content of 0.08% by mass. Using Carrier 34 and the toner, a developer was prepared and the properties thereof were determined by the procedure of Example 16. The results are shown in Table 2.

COMPARATIVE EXAMPLE 5

Carrier 35 was prepared by the procedure of Example 16, except for using, as a core particle, a calcined ferrite power containing Zr in an excessively large amount. Carrier 35 had an average particle diameter of 45 μm, a magnetic moment of 57 $Am^2/kg$ at 1 kilooersted, a content of particles with a particle diameter of 9 μm or less of 0.06% by weight, a Zr content of 7% by mass, a Bi content of 0% by mass, an Fe content of 9% by mass, a Mn content of 24% by mass, and a Mg content of 0.07% by mass. Using Carrier 35 and the toner, a developer was prepared and the properties thereof were determined by the procedure of Example 16. The results are shown in Table 2.

COMPARATIVE EXAMPLE 6

Carrier 36 was prepared by the procedure of Example 17, except for using, as a core particle, a calcined ferrite power containing Bi in an excessively large amount. Carrier 36 had an average particle diameter of 45 μm, a magnetic moment of 56 $Am^2/kg$ at 1 kilooersted, a content of particles with a particle diameter of 9 μm or less of 0.05% by weight, a Zr content of 0% by mass, a Bi content of 3% by mass, an Fe content of 9% by mass, a Mn content of 25% by mass, and a Mg content of 0.08% by mass. Using Carrier 36 and the toner, a developer was prepared and the properties thereof were determined by the procedure of Example 16. The results are shown in Table 2.

TABLE 2

| | Shape and surface of core particle | Roughness in halftone image | Carrier deposition | Reproducibility of character image | Charge decrease (μc/g) |
|---|---|---|---|---|---|
| Example 16 | B | B | A | A | 4.3 |
| Example 17 | A | B | A | A | 4.1 |
| Example 18 | A | A | A | A | 4.2 |
| Example 19 | A | A | A | A | 4.0 |
| Example 20 | A | A | B | A | 4.4 |
| Example 21 | A | A | B | A | 4.1 |
| Example 22 | A | B | B | A | 4.7 |
| Example 23 | A | B | A | B | 4.9 |
| Example 24 | A | A | A | A | 2.5 |
| Example 25 | A | A | A | A | 3.1 |
| Example 26 | A | A | A | A | 1.8 |
| Example 27 | A | A | A | A | 2.0 |
| Example 28 | A | A | A | A | 2.6 |
| Example 29 | A | A | A | A | 3.0 |
| Example 30 | A | A | A | A | 1.1 |
| Comp. Ex. 4 | B | D | | not determined | |
| Comp. Ex. 5 | C | D | D | not determined | |
| Comp. Ex. 6 | C | D | D | not determined | |

Carriers 19 to 33 (Examples 16 to 30) showed satisfactory properties, all of which passed the tests.

Carrier 34 (Comparative Example 4) showed roughness (irregular densities) in halftone image not usable in practice, failed the test and the other properties were not determined.

Carriers 35 and 36 (Comparative Examples 5 and 6) had undesirable shapes and showed irregular densities in halftone images not usable in practice, thus failed the tests, and the other properties were not determined.

EXAMPLE 31

Carrier 37 was prepared in the following manner.

In a Homo Mixer were dispersed 30 parts by weight of a vinylidene fluoride-hexafluoropropylene copolymer and 100 parts by weight of dimethylformamide for 10 minutes and thereby yielded a resin coating composition. The resin coating composition was applied to a core particle using a SPIRA COTA (registered trademark, available from Okada Seiko Co., Ltd.), was dried and thereby yielded a coating layer. The core particle used herein was a calcined ferrite powder having an average particle diameter of 45 μm and mainly comprising Fe, Mn, Mg and Zr. The resulting carrier particles were fired in an electric furnace at 280° C. for 2 hours. After cooling, the ferrite powder bulk was cracked using a 63-μm sieve and thereby yielded Carrier 37. Carrier 37 had an average particle diameter of 45 μm, a magnetic moment of 66 $Am^2/kg$ at 1 kilooersted, a content of particles with a particle diameter of 9 μm or less of 0.07% by weight, a dielectric breakdown voltage of 1100 V, a Zr content of 0.12% by mass, a Bi content of 0% by mass, an Fe content of 25% by mass, a Mn content of 13% by mass, and a Mg content of 0.06% by mass. The dielectric breakdown voltage herein was determined using a measuring instrument having a rotary sleeve housing a fixed magnet, and electrodes arranged at a distant from the sleeve of 1 mm by applying a direct-current voltage to the carrier.

A toner for use herein was prepared in the following manner.

In a Henschel mixer at 800 rpm were mixed 100 parts by weight of a polyester resin having a softening point of 102° C. as a binder resin, 4 parts by weight of a microwax having a melting point of 81° C. as a wax, 2 parts by weight of a fluorine-containing quaternary ammonium salt compound as a charge control agent, and 7 parts by weight of carbon black having an average particle diameter of 50 nm as a coloring agent. The mixture was melted and kneaded in a single-screw kneader Buss Co-kneader (trade name, available from Buss Co., Ltd.) with jacket-heating. The kneaded product was cooled and elongated using a cold-press machine, roughly pulverized with a cutter mill, pulverized by fine pulverizer using jet stream, and classified using an air-classifier, to yield colored matrix particles having a weight-average particle diameter of 8.40 μm and a volume-average particle diameter of 7 μm. A total of 0.5 part by weight of colloidal silica fine particles with a degree of hydrophobing of 50% was mixed with 100 parts by weight of the colored matrix particles in a Henschel mixer at 700 rpm and thereby yielded the toner.

The weight-average particle diameter and volume-average particle diameter of the colored matrix particles were determined with a Coulter Counter TA-II available from Beckman Coulter, Inc.

The shape and surface conditions of above-prepared Carrier 37 were evaluated. In addition, Carrier 37 and the above-prepared toner were mixed in a TURBULA Mixer and thereby yielded a developer having a toner concentration of 5% by weight. The developer was placed in the modified machine of the commercially available digital full-color printer IPSiO Color 8000 (trade name, available from Ricoh Company, Limited), and the roughness in half-tone image, carrier deposition, reproducibility of character image and charge decrease after reproduction of 150,000 copies were determined. The results are shown in Table 3.

EXAMPLE 32

Carrier 38 was prepared by the procedure of Example 31, except for using, as a core particle, a calcined ferrite powder having an average particle diameter of 45 μm and mainly comprising Fe, Mn, Mg and Bi. Carrier 38 had an average particle diameter of 45 μm, a magnetic moment of 65 $Am^2/kg$ at 1 kilooersted, a content of particles with a particle diameter of 9 μm or less of 0.06% by weight, a dielectric breakdown voltage of 1200 V, a Zr content of 0% by mass, a Bi content of 0.016% by mass, an Fe content of 25% by mass, a Mn content of 14% by mass, and a Mg content of 0.07% by mass. The dielectric breakdown voltage was determined by the procedure of Example 31. Using Carrier 38 and the toner, a developer was prepared and the properties thereof were determined by the procedure of Example 31. The results are shown in Table 3.

EXAMPLE 33

Carrier 39 was prepared by the procedure of Example 31, except for using, as a core particle, a calcined ferrite powder having an average particle diameter of 45 μm and mainly comprising Fe, Mn, Mg, Zr and Bi. Carrier 39 had an average particle diameter of 45 μm, a magnetic moment of 68 $Am^2/kg$ at 1 kilooersted, a content of particles with a particle diameter of 9 μm or less of 0.05% bv weight, a dielectric breakdown voltage of 1600 V, a Zr content of 0.13% by mass, a Bi content of 0.015% by mass, an Fe content of 25% by mass, a Mn content of 13% by mass, and a Mg content of 0.06% by mass. The dielectric breakdown voltage was determined by the procedure of Example 31. Using Carrier 39 and the toner, a developer was prepared and the properties thereof were determined by the procedure of Example 31. The results are shown in Table 3.

EXAMPLE 34

Carrier 40 was prepared by the procedure of Example 33, except for using, as a core particle, a calcined ferrite powder containing Mg in a lager amount. Carrier 40 had an average particle diameter of 45 μm, a magnetic moment of 75 $Am^2/kg$ at 1 kilooersted, a content of particles with a particle diameter of 9 μm or less of 0.03% by weight, a dielectric breakdown voltage of 2000 V, a Zr content of 0.12% by mass, a Bi content of 0.015% by mass, an Fe content of 25% by mass, a Mn content of 13% by mass, and a Mg content of 0.21% by mass. The dielectric breakdown voltage was determined by the procedure of Example 31. Using Carrier 40 and the toner, a developer was prepared and the properties thereof were determined by the procedure of Example 31. The results are shown in Table 3.

EXAMPLE 35

Carrier 41 was prepared by the procedure of Example 34, except for using, as a core particle, a calcined ferrite powder having a smaller average particle diameter of 19 μm, using a 22-μm sieve for cracking and using a resin coating composition comprising 71 parts by weight of a vinylidene fluoride-hexafluoropropylene copolymer and 237 parts by weight of dimethylformamide. Carrier 41 had an average particle diameter of 19 μm, a magnetic moment of 76 $Am^2/kg$ at 1 kilooersted, a content of particles with a particle diameter of 9 μm or less of 1.33% by weight, a dielectric breakdown voltage of 2000 V, a Zr content of 0.13% by mass, a Bi content of 0.016% by mass, an Fe content of 25% by mass, a Mn content of 14% by mass, and a Mg content of 0.20% by mass. The dielectric breakdown voltage was determined by the procedure of Example 31. Using Carrier 41 and the toner, a developer was prepared and the properties thereof were determined by the procedure of Example 31. The results are shown in Table 3.

EXAMPLE 36

Carrier 42 was prepared by the procedure of Example 35, except for using, as a core particle, a calcined ferrite powder having a larger average particle diameter of 70 μm, using a 106-μm sieve for cracking and using a resin coating composition comprising 20 parts by weight of a vinylidene fluoride-hexafluoropropylene copolymer and 65 parts by weight of dimethylformamide. Carrier 42 had an average particle diameter of 70 μm, a magnetic moment of 73 $Am^2/kg$ at 1 kilooersted, a content of particles with a particle diameter of 9 μm or less of 0.01% by weight, a dielectric breakdown voltage of 2100 V, a Zr content of 0.12% by mass, a Bi content of 0.015% by mass, an Fe content of 25% by mass, a Mn content of 13% by mass, and a Mg content of 0.19% by mass. The dielectric breakdown voltage was determined by the procedure of Example 31. Using Carrier 42 and the toner, a developer was prepared and the properties thereof were determined by the procedure of Example 31. The results are shown in Table 3.

EXAMPLE 37

Carrier 43 was prepared by the procedure of Example 34, except for using, as a core particle, a calcined ferrite powder containing particles with a small particle diameter in a larger amount. Carrier 43 had an average particle diameter of 45 μm, a magnetic moment of 76 $Am^2/kg$ at 1 kilooersted, a content of particles with a particle diameter of 9 μm or less of 3.35% by weight, a dielectric breakdown voltage of 1800 V, a Zr content of 0.13% by mass, a Bi content of 0.016% by mass, an Fe content of 25% by mass, a Mn content of 14% by mass, and a Mg content of 0.20% by mass. The dielectric breakdown voltage was determined by the procedure of Example 31. Using Carrier 43 and the toner, a developer was prepared and the properties thereof were determined by the procedure of Example 31. The results are shown in Table 3.

EXAMPLE 38

Carrier 44 was prepared by the procedure of Example 34, except for using a resin coating composition comprising 132.2 parts by weight of a silicone resin solution SR2410 (trade name, available from Dow Corning Toray Silicone Co., Ltd.; solid content: 23% by weight), 0.66 part by weight of an aminosilane SH6020 (trade name, available from Dow Corning Toray Silicone Co., Ltd.; solid content: 100% by weight), 7 parts by weight of carbon black having an average particle diameter of 50 nm as a coloring agent and 300 parts by weight of toluene, and firing the carrier particles at 300° C. Carrier 44 had an average particle diameter of 45 μm, a magnetic moment of 76 $Am^2/kg$ at 1 kilooersted, a content of particles with a particle diameter of 9 μm or less of 0.02% by weight, a dielectric breakdown voltage of 2100 V, a Zr content of 0.13% by mass, a Bi content of 0.015% by mass, an Fe content of 25% by mass, a Mn content of 13% by mass, and a Mg content of 0.21% by mass. The dielectric breakdown voltage was determined by the procedure of Example 31. Using Carrier 44 and the toner, a developer was prepared and the properties thereof were determined by the procedure of Example 31. The results are shown in Table 3.

EXAMPLE 39

Carrier 45 was prepared by the procedure of Example 34, except for using a resin coating composition comprising 42.0 parts by weight of an acrylic resin solution (solid content: 50% by weight), 13.0 parts by weight of a guanamine solution (solid content: 70% by weight), 7 parts by weight of a carbon black having an average particle diameter of 50 nm as a coloring agent, 60 parts by weight of toluene and 60 parts by weight of butyl cellosolve, and firing the carrier particles at 150° C. Carrier 45 had an average particle diameter of 45 μm, a magnetic moment of 75 $Am^2/kg$ at 1 kilooersted, a content of particles with a particle diameter of 9 μm or less of 0.03% by weight, a dielectric breakdown voltage of 2200 V, a Zr content of 0.13% by mass, a Bi content of 0.015% by mass, an Fe content of 25% by mass, a Mn content of 14% by mass, and a Mg content of 0.19% by mass. The dielectric breakdown voltage was determined by the procedure of Example 31. Using Carrier 45 and the toner, a developer was prepared and the properties thereof were determined by the procedure of Example 31. The results are shown in Table 3.

EXAMPLE 40

Carrier 46 was prepared by the procedure of Example 34, except for using a resin coating composition comprising 66.1 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 21.0 parts by weight of an acrylic resin solution (solid content: 50% by weight), 6.5 parts by weight of a guanamine solution (solid content: 70% by weight), 7 parts by weight of carbon black having an average particle diameter of 50 nm as a coloring agent, 180 parts by weight of toluene and 30 parts by weight of butyl cellosolve, and firing the carrier particles at 150° C. Carrier 46 had an average particle diameter of 45 μm, a magnetic moment of 76 $Am^2/kg$ at 1 kilooersted, a content of particles with a particle diameter of 9 μm or less of 0.02% by weight, a dielectric breakdown voltage of 2200 V, a Zr content of 0.12% by mass, a Bi content of 0.016% by mass, an Fe content of 25% by mass, a Mn content of 14% by mass, and a Mg content of 0.21% by mass. The dielectric breakdown voltage was determined by the procedure of Example 31. Using Carrier 46 and the toner, a developer was prepared and the properties thereof were determined by the procedure of Example 31. The results are shown in Table 3.

EXAMPLE 41

Carrier 47 was prepared by the procedure of Example 40, except for using, as a core particle, a calcined ferrite powder having a smaller average particle diameter of 35 μm and using a resin coating composition comprising 85.0 parts by weight of a silicone resin solution SR2410 (trade name, available from Dow Corning Toray Silicone Co., Ltd.; solid content: 23% by weight), 0.42 part by weight of an aminosilane SH6020 (trade name, available from Dow Corning Toray Silicone Co., Ltd.; solid content: 100% by weight), 27.0 parts by weight of an acrylic resin solution (solid content: 50% by weight), 8.4 parts by weight of a guanamine solution (solid content: 70% by weight), 9 parts by weight of carbon black having an average particle diameter of 50 nm as a coloring agent, 230 parts by weight of toluene and 40 parts by weight of butyl cellosolve. Carrier 47 had an average particle diameter of 35 μm, a magnetic moment of 76 $Am^2/kg$ at 1 kilooersted, a content of particles with a particle diameter of 9 μm or less of 0.12% by weight, a dielectric breakdown voltage of 2300 V, a Zr content of 0.12% by mass, a Bi content of 0.016% by mass, an Fe content of 25% by mass, a Mn content of 14% by mass, and a Mg content of 0.20% by mass. The dielectric breakdown voltage was determined by the procedure of Example 31. Using Carrier 47 and the toner, a developer was prepared and the properties thereof were determined by the procedure of Example 31. The results are shown in Table 3.

EXAMPLE 42

Carrier 48 was prepared by the procedure of Example 40, except for using a resin coating composition comprising 123.9 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 3.0 parts by weight of an acrylic resin solution (solid content: 50% by weight), 0.65 part by weight of a guanamine solution (solid content: 70% by weight), 7 parts by weight of carbon black having an average particle diameter of 50 nm as a coloring agent, 180 parts by weight of toluene and 30 parts by weight of butyl cellosolve. Carrier 48 had an average particle diameter of 45 μm, a magnetic moment of 76 $Am^2/kg$ at 1 kilooersted, a content of particles with a particle diameter of 9 μm or less of 0.03% by weight, a dielectric breakdown voltage of 2100 V, a Zr content of 0.12% by mass, a Bi content of 0.015% by mass, an Fe content of 25% by mass, a Mn content of 13% by mass, and a Mg content of 0.19% by mass. The dielectric breakdown voltage was determined by the procedure of Example 31. Using Carrier 48 and the toner, a developer was prepared and the properties thereof were determined by the procedure of Example 31. The results are shown in Table 3.

EXAMPLE 43

Carrier 49 was prepared by the procedure of Example 42, except for using a resin coating composition comprising 6.5 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 57.0 parts by weight of an acrylic resin solution (solid content: 50% by weight), 12.4 part by weight of a guanamine solution (solid content: 70% by weight), 7 parts by weight of carbon black having an average particle diameter of 50 nm as a coloring agent, 80 parts by weight of toluene and 30 parts by weight of butyl cellosolve. Carrier 49 had an average particle diameter of 45 μm, a magnetic moment of 75 $Am^2/kg$ at 1 kilooersted, a content of particles with a particle diameter of 9 μm or less of 0.02% by weight, a dielectric breakdown voltage of 2100 V, a Zr content of 0.13% by mass, a Bi content of 0.016% by mass, an Fe content of 25% by mass, a Mn content of 13% by mass, and a Mg content of 0.20% by mass. The dielectric breakdown voltage was determined by the procedure of Example 31. Using Carrier 49 and the toner, a developer was prepared and the properties thereof were determined by the procedure of Example 31. The results are shown in Table 3.

EXAMPLE 44

Carrier 50 was prepared by the procedure of Example 40, except for employing the following procedures.

Initially, a resin coating composition for lower coating layer was prepared by dispersing 21.0 parts by weight of an acrylic resin solution (solid content: 50% by weight), 6.5 parts by weight of a guanamine solution (solid content: 70% by weight), 7 parts by weight of carbon black having an average particle diameter of 50 nm as a coloring agent, 30 parts by weight of toluene and 30 parts by weight of butyl cellosolve in a Homo Mixer for 10 minutes. Using the same core particle as in Example 40, the resin coating composition was applied to the core particle using SPIRA COTA (registered trademark, available from Okada Seiko Co., Ltd.), was dried and thereby yielded an intermediate carrier having a lower coating layer.

A resin coating composition for upper coating layer was prepared by dispersing 66.1 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight) and 150 parts by weight of toluene in a Homo Mixer for 10 minutes. The resin coating composition was applied to the intermediate carrier, was dried and thereby yielded an upper coating layer thereon. The carrier having two-layer coating structure was fired in an electric furnace at 150° C. for 1 hour. After cooling, the ferrite powder bulk was cracked using a 63-μm sieve and thereby yielded Carrier 50. Carrier 50 had an average particle diameter of 45 μm, a magnetic moment of 75 $Am^2/kg$ at 1 kilooersted, a content of particles with a particle diameter of 9 μm or less of 0.03% by weight, a dielectric breakdown voltage of 2300 V, a Zr content of 0.12% by mass, a Bi content of 0.016% by mass, an Fe content of 25% by mass, a Mn content of 14% by mass, and a Mg content of 0.21% by mass. The dielectric breakdown voltage was determined by the procedure of Example 31. Using Carrier 50 and the toner, a developer was prepared and the properties thereof were determined by the procedure of Example 31. The results are shown in Table 3.

EXAMPLE 45

Carrier 51 was prepared by the procedure of Example 34, except for using, as a core particle, a calcined ferrite powder comprising principal elements in different amounts and having a higher magnetic moment. Carrier 51 had an average particle diameter of 45 μm, a magnetic moment of 92 $Am^2/kg$ at 1 kilooersted, a content of particles with a particle diameter of 9 μm or less of 0.05% by weight, a dielectric breakdown voltage of 800 V, a Zr content of 0.12% by mass, a Bi content of 0.015% by mass, an Fe content of 30% by mass, a Mn content of 18% by mass, and a Mg content of 0.25% by mass. The dielectric breakdown voltage was determined by the procedure of Example 31. Using Carrier 51 and the toner, a developer was prepared and the properties thereof were determined by the procedure of Example 31. The results are shown in Table 3.

COMPARATIVE EXAMPLE 7

Carrier 52 was prepared by the procedure of Example 16, except for using, as a core particle, a calcined ferrite power containing no Zr. Carrier 52 had an average particle diameter of 45 μm, a magnetic moment of 62 $Am^2/kg$ at 1 kilooersted, a content of particles with a particle diameter of 9 μm or less of 0.06% by weight, a dielectric breakdown voltage of 600 V, a Zr content of 0% by mass, a Bi content of 0% by mass, an Fe content of 25% by mass, a Mn content of 13% by mass, and a Mg content of 0.06% by mass. The dielectric breakdown voltage was determined by the procedure of Example 31. Using Carrier 52 and the toner, a developer was prepared and the properties thereof were determined by the procedure of Example 31. The results are shown in Table 3.

COMPARATIVE EXAMPLE 8

Carrier 53 was prepared by the procedure of Example 31, except for using, as a core particle, a calcined ferrite powder containing Zr in a larger amount. Carrier 53 had an average particle diameter of 45 μm, a magnetic moment of 45 $Am^2/kg$ at 1 kilooersted, a content of particles with a particle diameter of 9 μm or less of 0.06% by weight, a dielectric breakdown voltage of 1000 V, a Zr content of 6.8% by mass, a Bi content of 0% by mass, an Fe content of 25% by mass, a Mn content of 14% by mass, and a Mg content of 0.07% by mass. The dielectric breakdown voltage was determined by the procedure of Example 31. Using Carrier 53 and the toner, a developer was prepared and the properties thereof were determined by the procedure of Example 31. The results are shown in Table 3.

COMPARATIVE EXAMPLE 9

Carrier 54 was prepared by the procedure of Example 32, except for using, as a core particle, a calcined ferrite powder containing Bi in a larger amount. Carrier 54 had an average particle diameter of 45 μm, a magnetic moment of 44 $Am^2/kg$ at 1 kilooersted, a content of particles with a particle diameter of 9 μm or less of 0.05% by weight, a dielectric breakdown voltage of 1000 V, a Zr content of 0% by mass, a Bi content of 2.9% by mass, an Fe content of 25% by mass, a Mn content of 14% by mass, and a Mg content of 0.08% by mass. The dielectric breakdown voltage was determined by the procedure of Example 31. Using Carrier 54 and the toner, a developer was prepared and the properties thereof were determined by the procedure of Example 31. The results are shown in Table 3.

TABLE 3

| | Shape and surface of core particle | Roughness in halftone image | Carrier deposition | Reproducibility of character image | Charge decrease (μc/g) |
|---|---|---|---|---|---|
| Example 31 | B | C | B | A | 4.2 |
| Example 32 | A | C | B | A | 4.3 |
| Example 33 | A | B | B | A | 4.2 |
| Example 34 | A | B | A | A | 4.0 |
| Example 35 | A | A | B | A | 4.4 |
| Example 36 | A | A | A | B | 2.7 |
| Example 37 | A | A | B | A | 4.1 |
| Example 38 | A | A | A | A | 2.3 |

TABLE 3-continued

| | Shape and surface of core particle | Roughness in halftone image | Carrier deposition | Reproducibility of character image | Charge decrease (μc/g) |
|---|---|---|---|---|---|
| Example 39 | A | A | A | A | 2.6 |
| Example 40 | A | A | A | A | 1.7 |
| Example 41 | A | A | A | A | 2.0 |
| Example 42 | A | A | A | A | 2.5 |
| Example 43 | A | A | A | A | 2.5 |
| Example 44 | A | A | A | A | 1.3 |
| Example 45 | A | C | B | C | not determined |
| Comp. Ex. 7 | B | D | D | not determined | |
| Comp. Ex. 8 | C | C | D | not determined | |
| Comp. Ex. 9 | C | C | D | not determined | |

Carriers 37 to 50 (Examples 31 to 44) showed satisfactory properties, all of which passed the tests. Carrier 51 (Example 45) showed insufficient properties in roughness in halftone image and reproducibility of character image while at practically usable levels, and the other properties were not determined. Carrier 52 (Comparative Example 7) showed roughness in halftone image and carrier deposition, which are not practically usable, and the other properties were not determined. Carriers 53 and 54 (Comparative Examples 8 and 9) had undesirable shapes and showed roughness in halftone images and carrier deposition, which are not usable in practice, and the other properties were not determined.

EXAMPLE 46

Carrier 55 was prepared in the following manner.

In a Homo Mixer were dispersed 30 parts by weight of a vinylidene fluoride-hexafluoropropylene copolymer and 100 parts by weight of dimethylformamide for 10 minutes and thereby yielded a resin coating composition. The resin coating composition was applied to a core particle using a SPIRA COTA (registered trademark, available from Okada Seiko Co., Ltd.), was dried and thereby yielded a coating layer. The core particle used herein was a calcined ferrite powder having an average particle diameter of 45 μm and mainly comprising Fe, Mn, Mg and Zr. The resulting carrier particles were fired in an electric furnace at 280° C. for 2 hours. After cooling, the ferrite powder bulk was cracked using a 63-μm sieve and thereby yielded Carrier 55. Carrier 55 had an average particle diameter of 45 μm, a magnetic moment of 65 $Am^2/kg$ at 1 kilooersted, a content of particles with a particle diameter of 9 μm or less of 0.06% by weight, a dielectric breakdown voltage of 500 V, a Zr content of 0.13% by mass, a Bi content of 0% by mass, an Fe content of 25% by mass, a Mn content of 13% by mass, and a Mg content of 0.06% by mass. The dielectric breakdown voltage was determined by using a bridge measuring instrument at a distance between electrodes of 2 mm±0.3 mm and applying a direct-current voltage to particles in a chain form in a magnetic field of 1500 gauss.

A toner for use herein was prepared in the following manner.

In a Henschel mixer at 800 rpm were mixed 100 parts by weight of a polyester resin having a softening point of 102° C. as a binder resin, 4 parts by weight of a microwax having a melting point of 81° C. as a wax, 2 parts by weight of a fluorine-containing quaternary ammonium salt compound as a charge control agent, and 7 parts by weight of carbon black having an average particle diameter of 50 nm as a coloring agent. The mixture was melted and kneaded in a single-screw kneader Buss Co-kneader (trade name, available from Buss Co., Ltd.) with jacket-heating. The kneaded product was cooled and elongated using a cold-press machine, roughly pulverized with a cutter mill, pulverized by fine pulverizer using jet stream, and classified using an air-classifier, to yield colored matrix particles having a weight-average particle diameter of 0.43 μm and a volume-average particle diameter of 7 μm. A total of 0.5 part by weight of colloidal silica fine particles with a degree of hydrophobing of 50% was mixed with 100 parts by weight of the colored matrix particles in a Henschel mixer at 700 rpm and thereby yielded the toner.

The weight-average particle diameter and volume-average particle diameter of the colored matrix particles were determined with a Coulter Counter TA-II available from Beckman Coulter, Inc.

The shape and surface conditions of above-prepared Carrier 55 were evaluated. In addition, Carrier 55 and the above-prepared toner were mixed in a TURBULA Mixer and thereby yielded a developer having a toner concentration of 5% by weight. The developer was placed in the modified machine of the commercially available digital full-color printer IPSiO Color 8000 (trade name, available from Ricoh Company, Limited), and the roughness in halftone image, carrier deposition, reproducibility of character image and charge decrease after reproduction of 150,000 copies were determined. The results are shown in Table 4.

EXAMPLE 47

Carrier 56 was prepared by the procedure of Example 46, except for using, as a core particle, a calcined ferrite powder having an average particle diameter of 45 μm and mainly comprising Fe, Mn, Mg and Bi. Carrier 56 had an average particle diameter of 45 μm, a magnetic moment of 65 $Am^2/kg$ at 1 kilooersted, a content of particles with a particle diameter of 9 μm or less of 0.05% by weight, a dielectric breakdown voltage of 500 V, a Zr content of 0% by mass, a Bi content of 0.015% by mass, an Fe content of 25% by mass, a Mn content of 14% by mass, and a Mg content of 0.07% by mass. The dielectric breakdown voltage was determined by the procedure of Example 46. Using Carrier 56 and the toner, a developer was prepared and the properties thereof were determined by the procedure of Example 46. The results are shown in Table 4.

EXAMPLE 48

Carrier 57 was prepared by the procedure of Example 46, except for using, as a core particle, a calcined ferrite powder having an average particle diameter of 45 μm and mainly comprising Fe, Mn, Mg, Zr and Bi. Carrier 57 had an average particle diameter of 45 μm, a magnetic moment of 68 $Am^2/kg$ at 1 kilooersted, a content of particles with a particle diameter of 9 μm or less of 0.03% bv weight, a dielectric breakdown voltage of 500 V, a Zr content of 0.13% by mass, a Bi-content of 0.016% by mass, an Fe content of 25% by mass, a Mn content of 14% by mass, and a Mg content of 0.06% by mass. The dielectric breakdown voltage was determined by the procedure of Example 46. Using Carrier 57 and the toner, a developer was prepared and the properties thereof were determined by the procedure of Example 46. The results are shown in Table 4.

EXAMPLE 49

Carrier 58 was prepared by the procedure of Example 48, except for using, as a core particle, a calcined ferrite powder containing Mg in a lager amount. Carrier 58 had an average particle diameter of 45 μm, a magnetic moment of 76 $Am^2/kg$ at 1 kilooersted, a content of particles with a particle diameter of 9 μm or less of 0.02% by weight, a dielectric breakdown voltage of 1000 V or more, a Zr content of 0.12% by mass, a Bi content of 0.015% by mass, an Fe content of 25% by mass, a Mn content of 13% by mass, and a Mg content of 0.20% by mass. The dielectric breakdown voltage was determined by the procedure of Example 46. Using Carrier 58 and the toner, a developer was prepared and the properties thereof were determined by the procedure of Example 46. The results are shown in Table 4.

EXAMPLE 50

Carrier 59 was prepared by the procedure of Example 49, except for using, as a core particle, a calcined ferrite powder having a smaller average particle diameter of 19 μm, using a 22-μm sieve for cracking and using a resin coating composition comprising 71 parts by weight of a vinylidene fluoride-hexafluoropropylene copolymer and 237 parts by weight of dimethylformamide. Carrier 59 had an average particle diameter of 19 μm, a magnetic moment of 75 $Am^2/kg$ at 1 kilooersted, a content of particles with a particle diameter of 9 μm or less of 1.31% by weight, a dielectric breakdown voltage of 1000 V or more, a Zr content of 0.12% by mass, a Bi content of 0.016% by mass, an Fe content of 25% by mass, a Mn content of 13% by mass, and a Mg content of 0.19% by mass. The dielectric breakdown voltage was determined by the procedure of Example 46. Using Carrier 59 and the toner, a developer was prepared and the properties thereof were determined by the procedure of Example 46. The results are shown in Table 4.

EXAMPLE 51

Carrier 60 was prepared by the procedure of Example 50, except for using, as a core particle, a calcined ferrite powder having a larger average particle diameter of 70 μm, using a 106-μm sieve for cracking and using a resin coating composition comprising 20 parts by weight of a vinylidene fluoride-hexafluoropropylene copolymer and 65 parts by weight of dimethylformamide. Carrier 60 had an average particle diameter of 70 μm, a magnetic moment of 73 $Am^2/kg$ at 1 kilooersted, a content of particles with a particle diameter of 9 μm or less of 0.01% by weight, a dielectric breakdown voltage of 1000 V or more, a Zr content of 0.12% by mass, a Bi content of 0.015% by mass, an Fe content of 25% by mass, a Mn content of 14% by mass, and a Mg content of 0.19% by mass. The dielectric breakdown voltage was determined by the procedure of Example 46. Using Carrier 60 and the toner, a developer was prepared and the properties thereof were determined by the procedure of Example 46. The results are shown in Table 4.

EXAMPLE 52

Carrier 61 was prepared by the procedure of Example 49, except for using, as a core particle, a calcined ferrite powder containing particles with a small particle diameter in a larger amount. Carrier 43 had an average particle diameter of 45 μm, a magnetic moment of 75 $Am^2/kg$ at 1 kilooersted, a content of particles with a particle diameter of 9 μm or less of 3.32% by weight, a dielectric breakdown voltage of 1000 V or more, a Zr content of 0.13% by mass, a Bi content of 0.015% by mass, an Fe content of 25% by mass, a Mn content of 14% by mass, and a Mg content of 0.20% by mass. The dielectric breakdown voltage was determined by the procedure of Example 46. Using Carrier 61 and the toner, a developer was prepared and the properties thereof were determined by the-procedure of Example 46. The results are shown in Table 4.

EXAMPLE 53

Carrier 62 was prepared by the procedure of Example 49, except for using a resin coating composition comprising 132.2 parts by weight of a silicone resin solution SR2410 (trade name, available from Dow Corning Toray Silicone Co., Ltd.; solid content: 23% by weight), 0.66 part by weight of an aminosilane SH6020 (trade name, available from Dow Corning Toray Silicone Co., Ltd.; solid content: 100% by weight), 7 parts by weight of carbon black having an average particle diameter of 50 nm as a coloring agent and 300 parts by weight of toluene, and firing the carrier particles at 300° C. Carrier 62 had an average particle diameter of 45 μm, a magnetic moment of 76 $Am^2/kg$ at 1 kilooersted, a content of particles with a particle diameter of 9 μm or less of 0.02% by weight, a dielectric breakdown voltage of 1000 V or more, a Zr content of 0.12% by mass, a Bi content of 0.015% by mass, an Fe content of 25% by mass, a Mn content of 13% by mass, and a Mg content of 0.20% by mass. The dielectric breakdown voltage was determined by the procedure of Example 46. Using Carrier 62 and the toner, a developer was prepared and the properties thereof were determined by the procedure of Example 46. The results are shown in Table 4.

EXAMPLE 54

Carrier 63 was prepared by the procedure of Example 49, except for using a resin coating composition comprising 42.0 parts by weight of an acrylic resin solution (solid content: 50% by weight), 13.0 parts by weight of a guanamine solution (solid content: 70% by weight), 7 parts by weight of a carbon black having an average particle diameter of 50 nm as a coloring agent, 60 parts by weight of toluene and 60 parts by weight of butyl cellosolve, and firing the carrier particles at 150° C. Carrier 63 had an average particle diameter of 45 μm, a magnetic moment of 75 $Am^2/kg$ at 1 kilooersted, a content of particles with a particle diameter of 9 μm or less of 0.02% by weight, a dielectric breakdown voltage of 1000 V or more, a Zr content of 0.13% by mass, a Bi content of 0.015% by mass, an Fe content of 25% by mass, a Mn content of 14% by mass, and a Mg content of 0.19% by mass. The dielectric breakdown voltage was determined by the procedure of Example 46. Using Carrier 63 and the toner, a developer was prepared and the properties thereof were determined by the procedure of Example 46. The results are shown in Table 4.

EXAMPLE 55

Carrier 64 was prepared by the procedure of Example 49, except for using a resin coating composition comprising 66.1 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 21.0 parts by weight of an acrylic resin solution (solid content: 50% by weight), 6.5 parts by weight of a guanamine solution (solid content: 70% by weight), 7 parts by weight of carbon black having an average particle diameter of 50 nm as a coloring agent, 180 parts by weight of toluene and 30 parts by weight of butyl cellosolve, and firing the carrier particles at 150° C. Carrier 64 had an average particle diameter of 45 μm, a magnetic moment of 75 $Am^2/kg$ at 1 kilooersted, a content of particles with a particle diameter of 9 μm or less of 0.03% by weight, a dielectric breakdown voltage of 1000 V or more, a Zr content of 0.13% by mass, a Bi content of 0.016% by mass, an Fe content of 25% by mass, a Mn content of 13% by mass, and a Mg content of 0.20% by mass. The dielectric breakdown voltage was determined by the procedure of Example 46. Using Carrier 64 and the toner, a developer was prepared and the properties thereof were determined by the procedure of Example 46. The results are shown in Table 4.

EXAMPLE 56

Carrier 65 was prepared by the procedure of Example 55, except for using, as a core particle, a calcined ferrite powder having a smaller average particle diameter of 35 μm and using a resin coating composition comprising 85.0 parts by weight of a silicone resin solution SR2410 (trade name, available from Dow Corning Toray Silicone Co., Ltd.; solid content: 23% by weight), 0.42 part by weight of an aminosilane SH6020 (trade name, available from Dow Corning Toray Silicone Co., Ltd.; solid content: 100% by weight), 27.0 parts by weight of an acrylic resin solution (solid content: 50% by weight), 8.4 parts by weight of a guanamine solution (solid content: 70% by weight), 9 parts by weight of carbon black having an average particle diameter of 50 nm as a coloring agent, 230 parts by weight of toluene and 40 parts by weight of butyl cellosolve. Carrier 65 had an average particle diameter of 35 μm, a magnetic moment of 76 $Am^2/kg$ at 1 kilooersted, a content of particles with a particle diameter of 9 μm or less of 0.12% by weight, a dielectric breakdown voltage of 1000 V or more, a Zr content of 0.12% by mass, a Bi content of 0.015% by mass, an Fe content of 25% by mass, a Mn content of 14% by mass, and a Mg content of 0.20% by mass. The dielectric breakdown voltage was determined by the procedure of Example 46. Using Carrier 65 and the toner, a developer was prepared and the properties thereof were determined by the procedure of Example 46. The results are shown in Table 4.

EXAMPLE 57

Carrier 66 was prepared by the procedure of Example 55, except for using a resin coating composition comprising 123.9 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 3.0 parts by weight of an acrylic resin solution (solid content: 50% by weight), 0.65 part by weight of a guanamine solution (solid content: 70% by weight), 7 parts by weight of carbon black having an average particle diameter of 50 nm as a coloring agent, 180 parts by weight of toluene and 30 parts by weight of butyl cellosolve. Carrier 66 had an average particle diameter of 45 μm, a magnetic moment of 75 $Am^2/kg$ at 1 kilooersted, a content of particles with a particle diameter of 9 μm or less of 0.03% by weight, a dielectric breakdown voltage of 1000 V or more, a Zr content of 0.13% by mass, a Bi content of 0.016% by mass, an Fe content of 25% by mass, a Mn content of 13% by mass, and a Mg content of 0.19% by mass. The dielectric breakdown voltage was determined by the procedure of Example 46. Using Carrier 66 and the toner, a developer was prepared and the properties thereof were determined by the procedure of Example 46. The results are shown in Table 4.

EXAMPLE 58

Carrier 67 was prepared by the procedure of Example 57, except for using a resin coating composition comprising 6.5 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight), 57.0 parts by weight of an acrylic resin solution (solid content: 50% by weight), 12.4 part by weight of a guanamine solution (solid content: 70% by weight), 7 parts by weight of carbon black having an average particle diameter of 50 nm as a coloring agent, 80 parts by weight of toluene and 30 parts by weight of butyl cellosolve. Carrier 67 had an average particle diameter of 45 μm, a magnetic moment of 76 $Am^2/kg$ at 1 kilooersted, a content of particles with a particle diameter of 9 μm or less of 0.03% by weight, a dielectric breakdown voltage of 1000 V or more, a Zr content of 0.13% by mass, a Bi content of 0.016% by mass, an Fe content of 25% by mass, a Mn content of 14% by mass, and a Mg content of 0.19% by mass. The dielectric breakdown voltage was determined by the procedure of Example 46. Using Carrier 67 and the toner, a developer was prepared and the properties thereof were determined by the procedure of Example 46. The results are shown in Table 4.

EXAMPLE 59

Carrier 68 was prepared by the procedure of Example 55, except for employing the following procedures.

Initially, a resin coating composition for lower coating layer was prepared by dispersing 21.0 parts by weight of an acrylic resin solution (solid content: 50% by weight), 6.5 parts by weight of a guanamine solution (solid content: 70% by weight), 7 parts by weight of carbon black having an average particle diameter of 50 nm as a coloring agent, 30 parts by weight of toluene and 30 parts by weight of butyl cellosolve in a Homo Mixer for 10 minutes. Using the same core particle as in Example 40, the resin coating composition was applied to the core particle using SPIRA COTA (registered trademark, available from Okada Seiko Co., Ltd.), was dried and thereby yielded an intermediate carrier having a lower coating layer.

A resin coating composition for upper coating layer was prepared by dispersing 66.1 parts by weight of a silicone resin solution SR2410 (trade name, available from Dow Corning Toray Silicone Co., Ltd.; solid content: 23% by weight), 0.33 part by weight of an aminosilane SH6020 (trade name, available from Dow Corning Toray Silicone Co., Ltd.; solid content: 100% by weight) and 150 parts by weight of toluene in a Homo Mixer for 10 minutes. The resin coating composition was applied to the intermediate carrier, was dried and thereby yielded an upper coating layer thereon. The carrier having two-layer coating structure was fired in an electric furnace at 150° C. for 1 hour. After cooling, the ferrite powder bulk was cracked using a 63-μm sieve and thereby yielded Carrier 68. Carrier 68 had an average particle diameter of 45 μm, a magnetic moment of 75 $Am^2/kg$ at 1 kilooersted, a content of particles with a particle diameter of 9 μm or less of 0.02% by weight, a dielectric breakdown voltage of 1000 V or more, a Zr content of 0.12% by mass, a Bi content of 0.015% by mass, an Fe content of 25% by mass, a Mn content of 13% by mass, and a Mg content of 0.20% by mass. The dielectric breakdown voltage was determined by the procedure of Example 46. Using Carrier 68 and the toner, a developer was prepared and the properties thereof were determined by the procedure of Example 46. The results are shown in Table 4.

EXAMPLE 60

Carrier 69 was prepared by the procedure of Example 49, except for using, as a core particle, a calcined ferrite powder comprising principal elements in different amounts and having a higher magnetic moment. Carrier 69 had an average particle diameter of 45 μm, a magnetic moment of 92 $Am^2/kg$ at 1 kilooersted, a content of particles with a particle diameter of 9 μm or less of 0.04% by weight, a dielectric breakdown voltage of 500 V, a Zr content of 0.12% by mass, a Bi content of 0.016% by mass, an Fe content of 31% by mass, a Mn content of 18% by mass, and a Mg content of 0.26% by mass. The dielectric breakdown voltage was determined by the procedure of Example 46. Using Carrier 69 and the toner, a developer was prepared and the properties thereof were determined by the procedure of Example 46. The results are shown in Table 4.

COMPARATIVE EXAMPLE 10

Carrier 70 was prepared by the procedure of Example 46, except for using, as a core particle, a calcined ferrite power containing no Zr. Carrier 70 had an average particle diameter of 45 μm, a magnetic moment of 63 $Am^2/kg$ at 1 kilooersted, a content of particles with a particle diameter of 9 μm or less of 0.06% by weight, a dielectric breakdown voltage of 250 V, a Zr content of 0% by mass, a Bi content of 0% by mass, an Fe content of 25% by mass, a Mn content of 13% by mass, and a Mg content of 0.07% by mass. The dielectric breakdown voltage was determined by the procedure of Example 46. Using Carrier 70 and the toner, a developer was prepared and the properties thereof were determined by the procedure of Example 46. The results are shown in Table 4.

COMPARATIVE EXAMPLE 11

Carrier 71 was prepared by the procedure of Example 46, except for using, as a core particle, a calcined ferrite powder containing Zr in a larger amount. Carrier 71 had an average particle diameter of 45 μm, a magnetic moment of 45 $Am^2/kg$ at 1 kilooersted, a content of particles with a particle diameter of 9 μm or less of 0.05% by weight, a dielectric breakdown voltage of 500 V, a Zr content of 7% by mass, a Bi content of 0% by mass, an Fe content of 25% by mass, a Mn content of 13% by mass, and a Mg content of 0.08% by mass. The dielectric breakdown voltage was determined by the procedure of Example 46. Using Carrier 71 and the toner, a developer was prepared and the properties thereof were determined by the procedure of Example 46. The results are shown in Table 4.

COMPARATIVE EXAMPLE 12

Carrier 72 was prepared by the procedure of Example 47, except for using, as a core particle, a calcined ferrite powder containing Bi in a larger amount. Carrier 72 had an average particle diameter of 45 μm, a magnetic moment of 43 $Am^2/kg$ at 1 kilooersted, a content of particles with a particle diameter of 9 μm or less of 0.05% by weight, a dielectric breakdown voltage of 500 V, a Zr content of 0% by mass, a Bi content of 3% by mass, an Fe content of 25% by mass, a Mn content of 14% by mass, and a Mg content of 0.08% by mass. The dielectric breakdown voltage was determined by the procedure of Example 46. Using Carrier 72 and the toner, a developer was prepared and the properties thereof were determined by the procedure of Example 46. The results are shown in Table 4.

TABLE 4

| | Shape and surface of core particle | Roughness in halftone image | Carrier deposition | Reproducibility of character image | Charge decrease (μc/g) |
|---|---|---|---|---|---|
| Example 46 | B | C | B | A | 4.3 |
| Example 47 | A | C | B | A | 4.2 |
| Example 48 | A | B | B | A | 4.1 |
| Example 49 | A | B | A | A | 4.0 |
| Example 50 | A | A | B | A | 4.5 |
| Example 51 | A | A | A | B | 2.8 |
| Example 52 | A | A | B | A | 4.2 |
| Example 53 | A | A | A | A | 2.4 |
| Example 54 | A | A | A | A | 2.5 |
| Example 55 | A | A | A | A | 1.8 |
| Example 56 | A | A | A | A | 2.0 |
| Example 57 | A | A | A | A | 2.5 |
| Example 58 | A | A | A | A | 2.6 |
| Example 59 | A | A | A | A | 1.2 |
| Example 60 | A | C | B | C | not determined |
| Comp. Ex. 10 | B | D | D | not determined | |
| Comp. Ex. 11 | C | C | D | not determined | |
| Comp. Ex. 12 | C | C | D | not determined | |

Carriers 55 to 68 (Examples 46 to 59) showed satisfactory properties, all of which passed the tests. Carrier 69 (Example 60) showed insufficient properties in roughness in halftone image while at practically usable level, and the other properties were not determined. Carrier 70 (Comparative Example 10) showed roughness in halftone image and carrier deposition, not usable in practice, and the other properties were not determined. Carriers 71 and 72 (Comparative Examples 11 and 12) had undesirable shapes and showed roughness in halftone image and carrier deposition, not usable in practice and failed the tests, and the other properties were not determined.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A carrier for latent electrostatic image development, comprising:

carrier particles, each carrier particle having:

a core particle; and a coating layer covering the core particle, wherein the core particle is a ferrite particle comprising at least one of Zr in an amount of from 0.01% by mass to 5% by mass and Bi in an amount of from 0.005% by mass to 1% by mass.

2. A carrier for latent electrostatic image development according to claim 1, wherein the ferrite particle comprises:

Fe in an amount of from 15% by mass to 45% by mass;

Mn in an amount of from 1% by mass to 25% by mass; and

Mg in an amount from 0.1% by mass to 1.0% by mass.

3. A carrier for latent electrostatic image development according to claim 1, which has a magnetic moment of from 40 $Am^2/kg$ to 90 $Am^2/kg$ at 1 kilooersted.

4. A carrier for latent electrostatic image development according to claim 1, wherein the carrier particles have a weight-average particle diameter Dw of from 20 μm to 65 μm, and wherein the content of carrier particles having a particle diameter of 9 μm or less is 3.0% by weight or less.

5. A carrier for latent electrostatic image development according to claim 1, wherein the coating layer comprises at least one of a silicone resin and an acrylic resin.

6. A carrier for latent electrostatic image development according to claim 5, wherein the acrylic resin is contained in the coating layer in an amount of from 10% by weight to 90% by weight.

7. A carrier for latent electrostatic image development according to claim 5, wherein the coating layer comprises a plurality of layers.

8. A developer, comprising:

a toner in the form of particles each having a binder resin and a coloring agent; and a carrier having carrier particles, each carrier particle having a core particle and a coating layer covering the core particle, wherein the core particle is a ferrite particle comprising at least one of Zr in an amount of from 0.01% by mass to 5% by mass and Bi in an amount of from 0.005% by mass to 1% by mass.

9. A developer according to claim 8, wherein the toner particles have a weight-average particle diameter Dw of from 3 μm to 10 μm.

10. A container housing a developer, the developer comprising:

a toner in the form of particles each having at least a binder resin and a coloring agent; and a carrier having carrier particles, each carrier particle having a core particle and a coating layer covering the core particle, wherein the core particle is a ferrite particle comprising at least one of Zr in an amount of from 0.01% by mass to 5% by mass and Bi in an amount of from 0.005% by mass to 1% by mass.

11. An image forming apparatus, comprising:

a latent electrostatic image bearing member for bearing a latent electrostatic image;

a latent electrostatic image forming unit for forming a latent electrostatic image on the latent electrostatic image bearing member;

a developing unit for developing the latent electrostatic image using a developer to form a visible image;

a transferring unit for transferring the visible image to a recording medium; and a fixing unit for fixing the transferred image on the recording medium, the developer comprising:

a toner in the form of particles each having at least a binder resin and a coloring agent; and a carrier having carrier particles, each carrier particle having a core particle and a coating layer covering the core particle, wherein the core particle is a ferrite particle comprising at least one of Zr in an amount of from 0.01% by mass to 5% by mass and Bi in an amount of from 0.005% by mass to 1% by mass.

12. An image forming process, comprising the steps of:

forming a latent electrostatic image on a latent electrostatic image bearing member;

developing the latent electrostatic image using a developer to form a visible image;

transferring the visible image to a recording medium; and fixing the transferred image on the recording medium, the developer comprising:

a toner in the form of particles each having at least a binder resin and a coloring agent; and a carrier having carrier particles, each carrier particle having a core particle and a coating layer covering the core particle, wherein the core particle is a ferrite particle comprising at least one of Zr in an amount of from 0.01% by mass to 5% by mass and Bi in an amount of from 0.005% by mass to 1% by mass.

13. A process cartridge, being attachable to and detachable from a main body of image forming apparatus and integrally comprising:

a developing unit for developing a latent electrostatic image using a developer to form a visible image; and at least one selected from the group consisting of:

a latent electrostatic image bearing member for bearing a latent electrostatic image;

a latent electrostatic image forming unit for forming a latent electrostatic image on the latent electrostatic image bearing member; and a cleaning unit for cleaning, the developer comprising:

a toner in the form of particles each having at least a binder resin and a coloring agent; and a carrier having carrier particles, each carrier particle having a core particle and a coating layer covering the core particle, wherein the core particle is a ferrite particle comprising at least one of Zr in an amount of from 0.01% by mass to 5% by mass and Bi in an amount of from 0.005% by mass to 1% by mass.

* * * * *